US006435350B1

(12) United States Patent
Huang et al.

(10) Patent No.: US 6,435,350 B1
(45) Date of Patent: Aug. 20, 2002

(54) PACK OF SELF-OPENING PLASTIC BAGS

(75) Inventors: Frank F. J. Huang; Daniel Huang, both of Tustin, CA (US)

(73) Assignee: Durabag Co., Inc., Tustin, CA (US)

( * ) Notice: Subject to any disclaimer, the term of this patent is extended or adjusted under 35 U.S.C. 154(b) by 0 days.

(21) Appl. No.: 09/046,027

(22) Filed: Mar. 23, 1998

Related U.S. Application Data

(60) Continuation-in-part of application No. 08/756,606, filed on Nov. 26, 1996, now Pat. No. 5,938,033, which is a division of application No. 08/328,154, filed on Oct. 24, 1994, now Pat. No. 5,670,013, which is a division of application No. 08/017,636, filed on Feb. 12, 1993, now abandoned.

(51) Int. Cl.[7] ..... B65D 33/14

(52) U.S. Cl. ..... 206/554; 383/37

(58) Field of Search ..... 206/554; 383/8, 383/9, 37, 906; 248/95, 97, 100

(56) References Cited

U.S. PATENT DOCUMENTS

| | | | | | |
|---|---|---|---|---|---|
| 4,560,067 | A | * | 12/1985 | Reimann | 206/554 |
| 4,759,639 | A | * | 7/1988 | DeMatteis | 206/554 |
| 5,188,235 | A | * | 2/1993 | Pierce et al. | 206/554 |
| 5,269,605 | A | * | 12/1993 | Nguyen | 206/554 |
| 5,335,788 | A | * | 8/1994 | Beasley et al. | 206/554 |
| 5,845,779 | A | * | 12/1998 | Wilfong, Jr. et al. | 206/554 |
| 5,865,313 | A | * | 2/1999 | Huang et al. | 206/554 |

* cited by examiner

*Primary Examiner*—Luan K. Bui
(74) *Attorney, Agent, or Firm*—Christie, Parker & Hale, LLP

(57) ABSTRACT

A pack of self-opening plastic bags adapted for use with a bagging rack. Each plastic bag preferably has an extension portion extending above an open mouth of the bag. At least one bag pack suspension aperture is formed at an upper region of the bag and is adapted for use in suspending the bag pack on a bagging rack. A carrying handle aperture is formed through an upper region of the bag pack. Areas of compression bonds are formed adjacent upper regions of the bag pack, the handle carrying apertures, and/or the suspension aperture.

2 Claims, 16 Drawing Sheets

FIG. 1
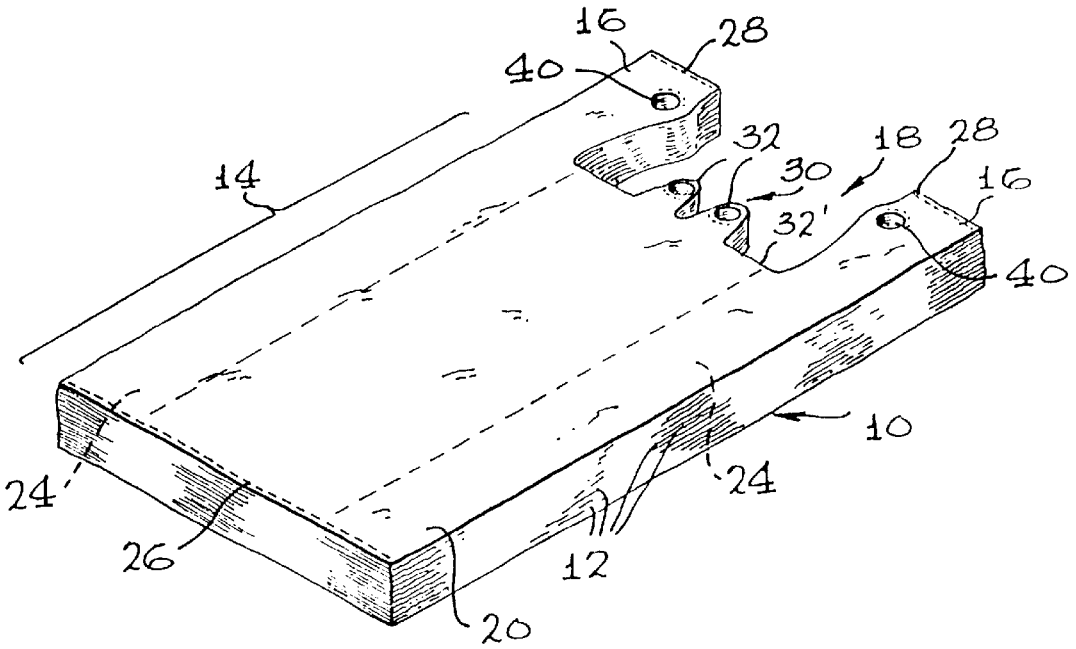
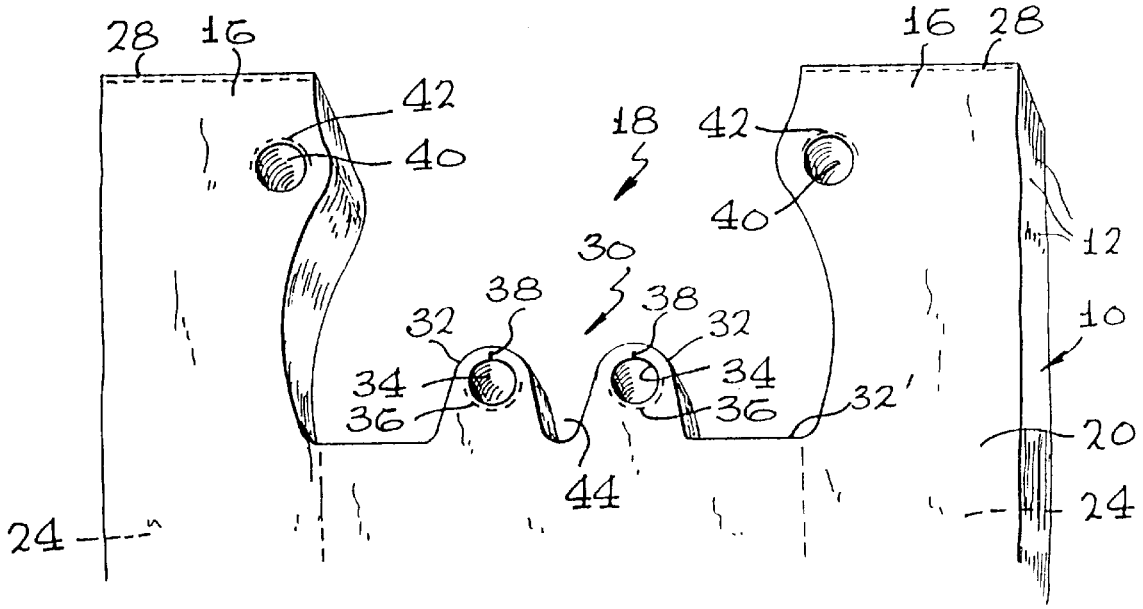
FIG. 2

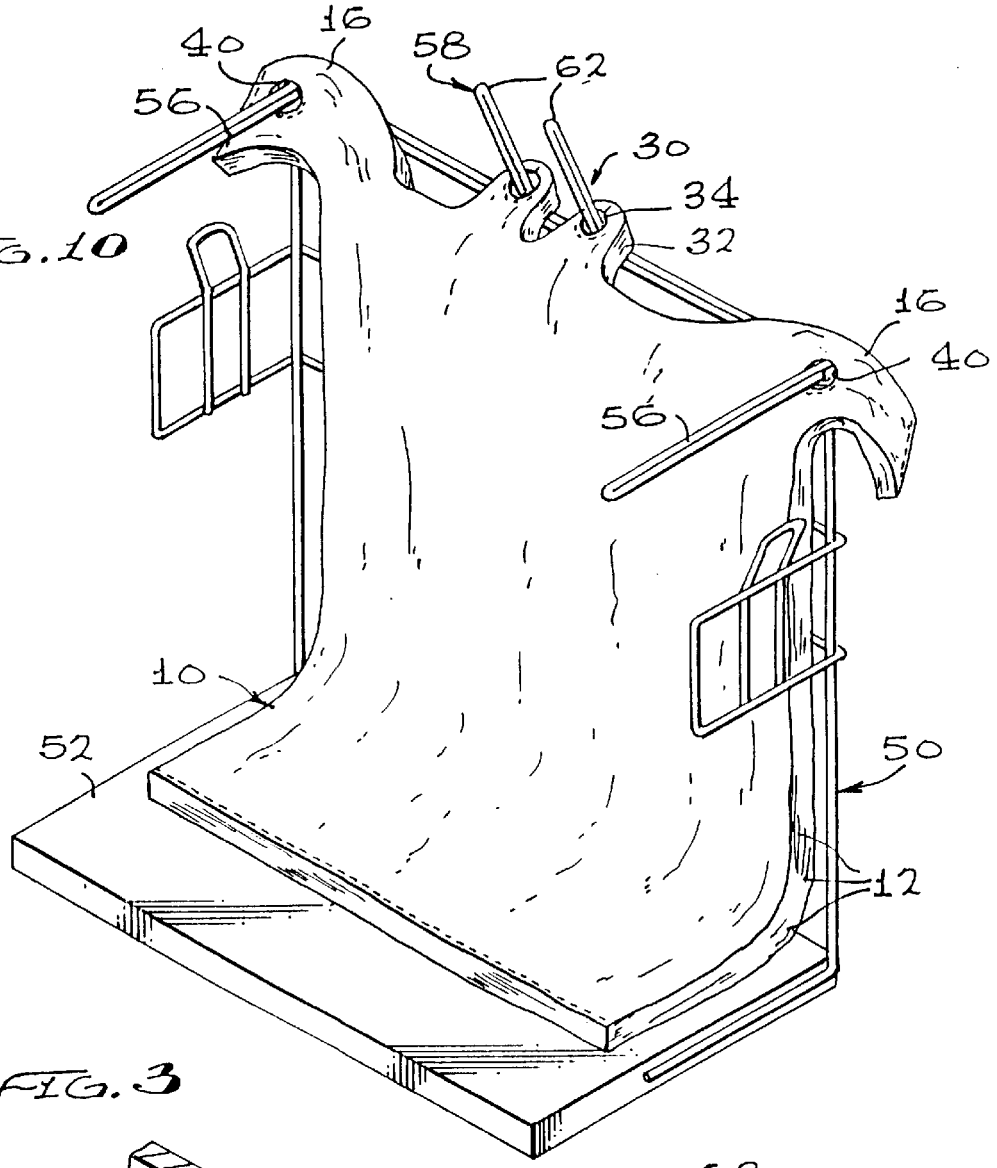
FIG. 10
FIG. 3
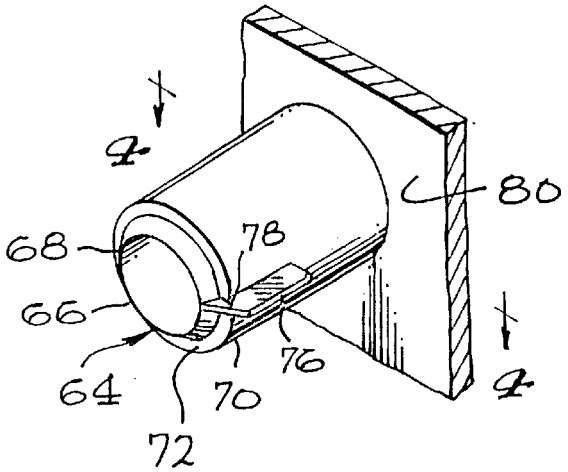
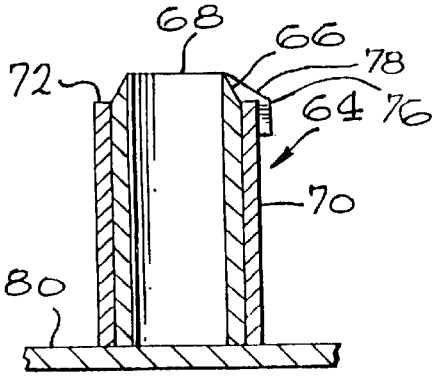
FIG. 4

FIG. 5
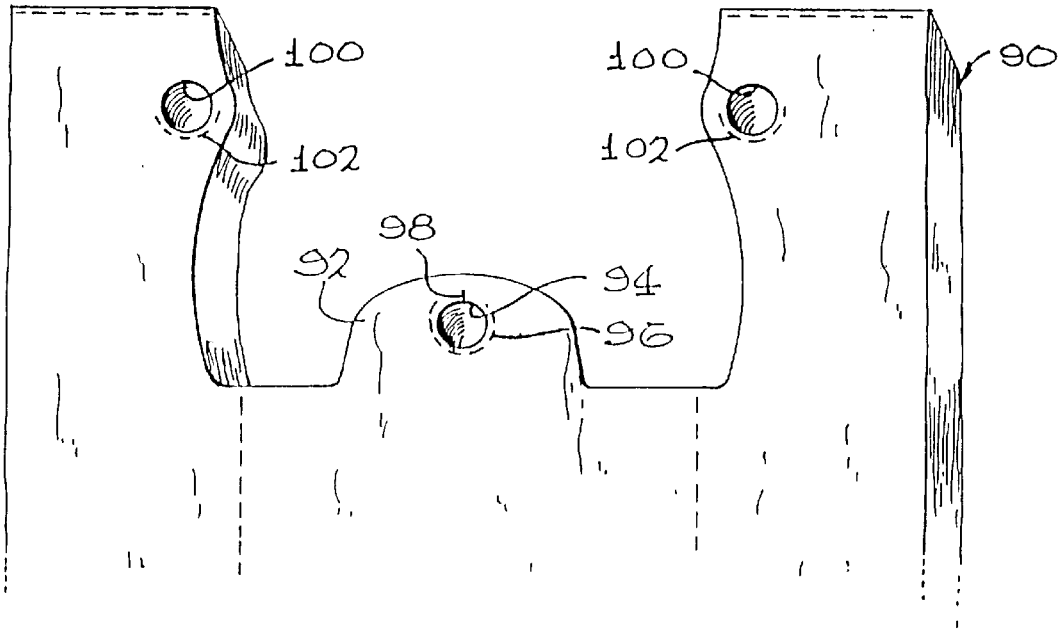
FIG. 6
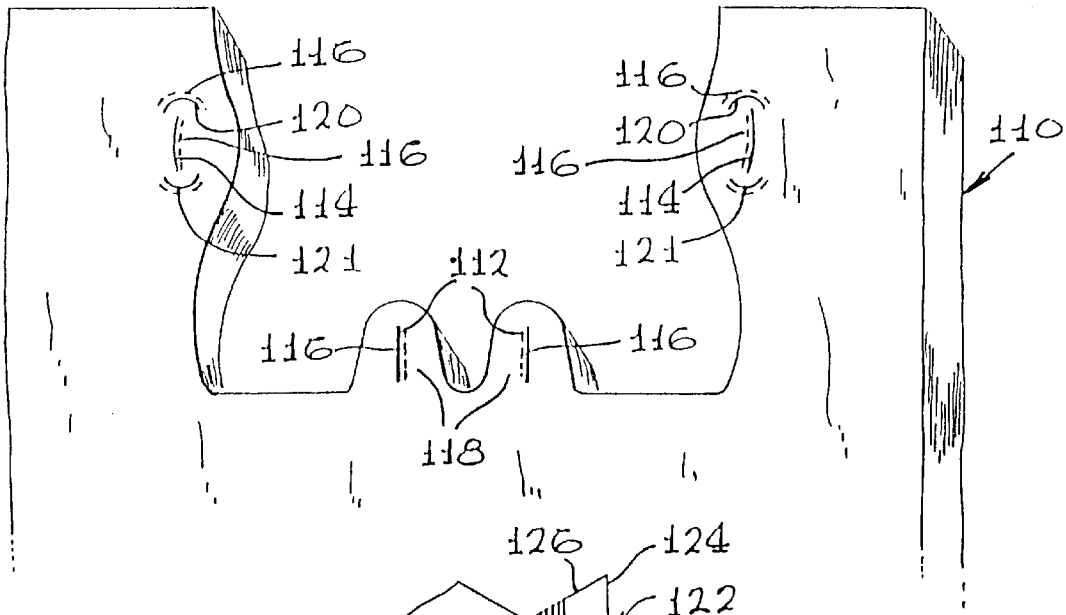
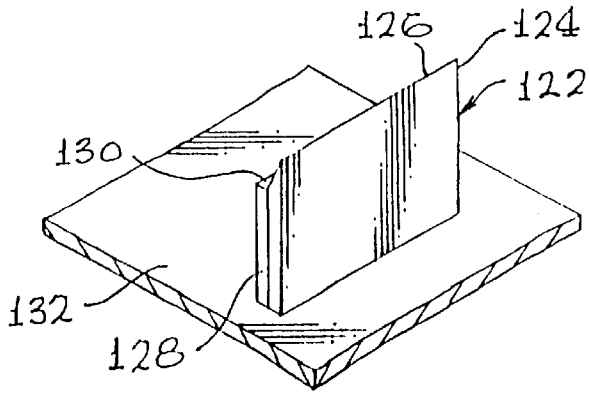
FIG. 7

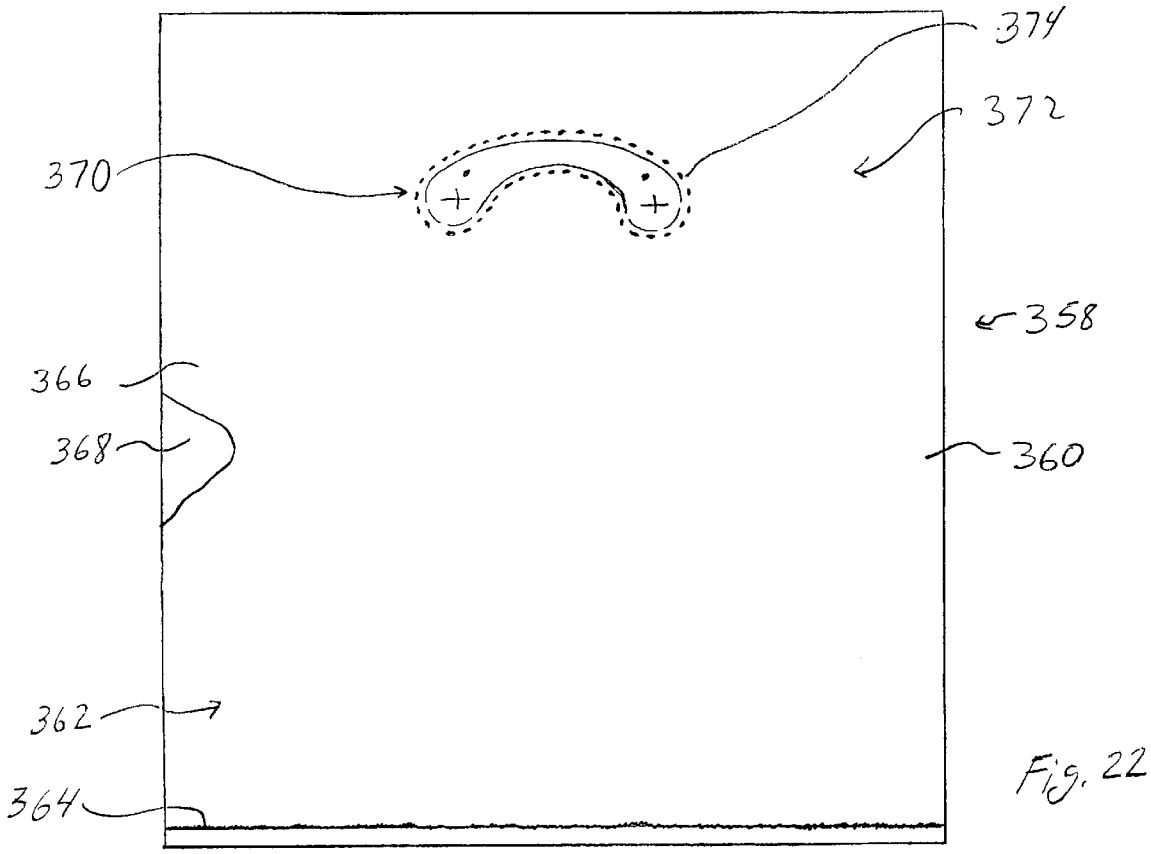
Fig. 22
Fig. 23
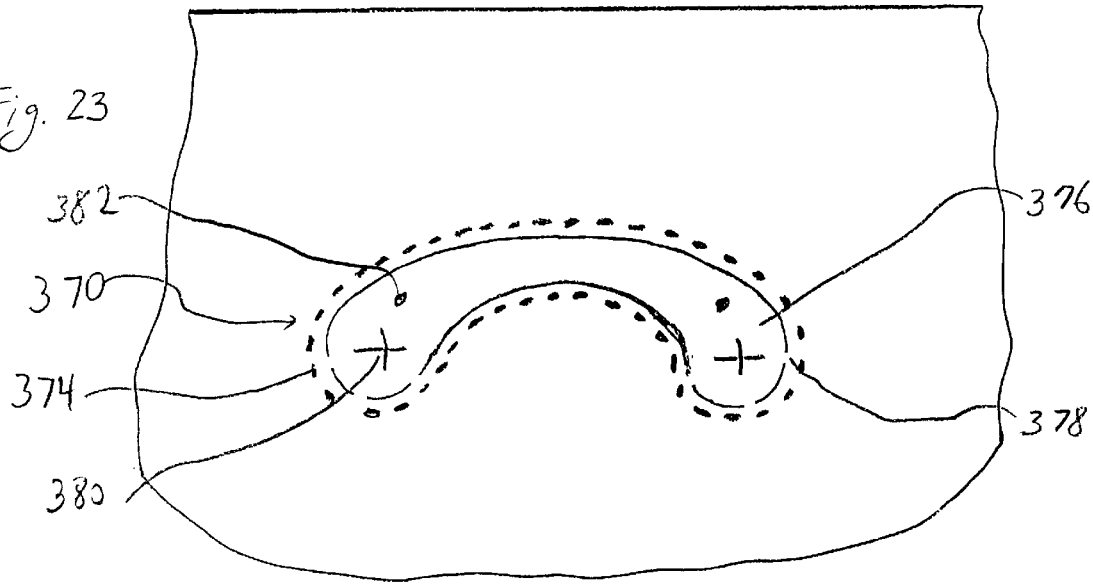

PACK OF SELF-OPENING PLASTIC BAGS

CROSS REFERENCE TO RELATED APPLICATIONS

This is a continuation-in-part application of application Ser. No. 08/756,606, filed Nov. 26, 1996 now U.S. Pat. No. 5,938,033, which is a divisional of application Ser. No. 08/328,154 filed Oct. 24, 1994 now U.S. Pat. No. 5,670,013, which is a divisional application of application Ser. No. 08/017,636 filed Feb. 12, 1993 now abandoned.

BACKGROUND OF THE INVENTION

1. Field of the Invention

This invention relates to plastic bags, and more particularly to a pack of T-shirt bags, merchandise bags, trash bags, and the like made preferably of polyolefins, and method of manufacturing same, which can be used with or without bagging racks and which provide for self-opening of the bags as each bag is removed from the pack of bags.

2. Description of the Prior Art

Since the mid-1980's, the use of plastic shopping bags has grown dramatically due to the great advantage plastic bags have over bags made of other materials, such as paper. Many types of plastic bags are made of low or high density polyethylene (LDPE and HDPE, respectively), but can be made of any of the polyolefins. LDPE and HDPE bags are stronger, lighter and much more compact to store than paper bags, saving valuable storage space at the merchants' check-out counter and storage areas. These attributes also make these bags less expensive to transport. LDPE and HDPE bags can be manufactured and sold at a fraction of the cost of competing paper bags, making them the bags of choice for merchants. LDPE and HDPE bags are also actually more environmentally friendly than paper bags since they require about 70 percent less energy to manufacture than competing paper bags and are readily recyclable, and when not recycled, are non-toxic when incinerated or disposed of in landfills.

Many groceries stores and other merchants now use a style of plastic bag to bag groceries and other merchandise commonly referred to as T-shirt bags. T-shirt bags are pleated bags which are closed, by heat sealing, at a bottom edge, and have-a pair of integral loop handles extending upwardly to define an open mouth of the bag therebetween. Because high density polyethylene (HDPE) has a greater resistance to stretching and deformation than LDPE plastic, HDPE plastic is generally used for. making T-shirt bags, although LDPE and other polyolefins can also be used. T-shirt bags are normally provided in packs of aligned bags and these packs of bags are usually used in conjunction with bagging racks.

T-shirt bags are generally manufactured by the following process. A continuous tube of HDPE plastic, or other plastic materials having the desired color, thickness, and diameter is formed on a extrusion machine. The continuous plastic tube is then passed over rollers to roll the continuous plastic tube onto a spool. If the bags to be formed from the continuous tube of HDPE are to be printed on one or both sides, the newly formed continuous plastic tube will be subjected to corona surface treatment, wherein the side or sides of the continuous flattened tube of plastic to be later printed will be passed by a high voltage corona discharge electrode. Corona surface treatment affects electrical and chemical changes on the plastic's outer surface to prepare that surface of the bag for printing. Regardless of whether or not the bags will be printed on one or both sides, it is a common practice in the plastic bag manufacturing industry to corona surface treat the entire outer surface of the rolls of continuous plastic tubing so that printing can be done on either one for both sides, if desired. It has been found that corona surface treatment, or other known methods to electrically and chemically change the entire outer surface of the continuous plastic tube, contributes somewhat to the self-opening feature of applicants' plastic bag pack system.

After being corona surface treated and rolled (if the bags might be printed), the roll of continuous plastic tube is unrolled and is then pleated on a pleating machine. Following this, a bagging machine heat seams and cuts sections of the pleated tube at top and bottom edges to form closed and flattened pleated bags of a desired length and width, with the pleated sides being at both sides of the flattened pleated bags. These sections are often referred to as pillowcases. Further downstream of the heat seaming and cutting step, the pillowcases are stacked in aligned stacks. Thereafter, hydraulic die cutting or other cutting methods are utilized to remove material at the stacked pillowcases' top portions to form the handles with apertures passing therethrough, and to form a mouth tab portion with an aperture to support the pack of self-opening bags on hooks positioned on a bagging rack. Each loop handle will comprise four layers of plastic material since they are cut out from the pleated side portions of the bag.

Despite the many advantages HDPE T-shirt bags have over paper bags, they are not self-standing like thicker and stiffer paper bags with a discreet flat bottom. This is due to their relatively thin and flexible material. In grocery stores settings, where quick and easy loading of bags is desirable, packs of T-shirt bags are generally supported on a bagging rack as merchandise is loaded into the bags to overcome the lack a of self-standing ability.

There are several popular styles of T-shirt bags available in packs of bags and bagging racks for use therewith, two main types of which will be discussed.

In one type of pack of T-shirt bags and bagging racks used therewith, the bagging rack has a support base, a wire rear wall with a tab receiving hook, and two wire arms extending forwardly over the base. In the center top portion of the arms, the wire is formed so as to have a section which will spread and hold apart the handles of T-shirt bags engaged therewith to open up the mouth of the T-shirt bag. The pack of T-shirt bags used with these styles of bagging racks consists of a stack of overlapped and aligned bags which have a lower bag portion with two handles extending upwardly at both sides of the mouth of the bags. A central tab portion is provided on the mouth of the bags between the two handles, and the central tab portions of the pack of bags are heat-sealed together. The heat sealed central tabs thus form a stack or book of central tabs and have a central tab slit formed therethrough. The central tab slit is engaged with the tab receiving hook on the rear wall of the bagging rack, and the bock of central tabs will remain engaged therewith, even after individual bags are removed. Below the central tab slit a tearing slit is provided which traverses almost the entire distance of the central tabs except for a small distance at both sides of the central tab portion. The tearing slit allows the individual bags to be torn off the pack of bags as they are needed, and looped onto the bagging rack.

A second major type of pack of T-shirt bag, and bagging rack designed to be used therewith, are disclosed in U.S. Pat. No. RE 33,264 to Baxley et al. Another version of this style of bagging rack is disclosed in U.S. Pat. No. 4,840,336 to Stroh et al. Both of these bagging racks have a bottom support base and a rear wire wall with a tab receiving hook located thereon. However, to open up each individual bag for loading, instead of looping the handles of the bags over the top of the support arm one at a time, as is done with the first type of pack of bags and rack, these racks have two handle support rods extending forwardly from the rear wire wall of the racks. The pack of T-shirt bags used with these styles of racks are similar to those used with the first type of rack, except that aligned apertures with flaps are formed on each handle of the pack of bags, through which pass the handle support rods of the bagging racks.

The prior art packs of T-shirt bags suffer from drawbacks. Prominent among these drawbacks include the lack of a convenient and easy to manufacture self-opening feature, to eliminate the need for the box person to struggle to open up each bag in the pack of bags.

In order to prepare a T-shirt bag for loading with merchandise, only the first layer of the bag material of the top bag, and no other layers must be pulled forward, thereby opening just the top bag. Since the HDPE material is very thin, typically between 1 to 0.5 mil thick (0.001 and 0.0005 inches), it is sometimes difficult for the checkout clerk or box person to grasp just the top layer of bag material. One can often see a sponge or source of tacky material, such as a glue stick, retained at the top of bagging racks, with which the checkout clerk or box person can dampen his or her fingers to aid in grasping just the top layer of material of the bag. However, this takes-additional time and effort in the bagging process. This cycle will have to be repeated with each successive bag to be loaded.

In addition, the prior art bag packs systems all leave waste books of heat bonded central tabs on the bagging rack. These books accumulate on the bagging rack and must be thrown out. Thirdly, in those styles of packs of bags which employ a central tab slit through their central tabs for mounting the pack of bags on a tab receiving hook of a bagging rack, it is sometimes difficult to engage the slitted central tab with the tab receiving hook. For those styles of bags packs having bagging rack suspension arm apertures defined by flaps through their handles for suspending the bag handles on bagging racks with suspension arms, the presence of the flaps in the apertures often make it difficult for the person loading a pack of bags to place the pack of bags on the rack.

Several approaches have been taken to overcome the lack of a self-opening feature problem. U.S. Pat. No. RE 33,264 to Baxley et al. discloses a pack of T-shirt bags wherein spots of adhesive are placed between the rear walls of the forwardly lying bags and the front walls of the rearwardly lying bags. The use of these spots of adhesive is intended to provide for self-opening of the bags as each successive bag is pulled off the pack of bags on the bagging rack. However, the use of spots of adhesive is undesirable from a cost and reliability standpoint because an extra manufacturing step of depositing spots of adhesive on the growing stack of pillowcases as each subsequent pillowcases is stacked thereon is required.

U.S. Pat. No. 5,074,674 to Kuklies et al. discloses a packs of bags similar to that of Baxley, et al. wherein the front wall of each bag is either relieved or removed in the region of the central tab so as not to be retained by the tab receiving hook on the bagging rack, purportedly allowing the front wall of the bag to be grasped more easily to open the bag. However, this style also requires an extra, and difficult manufacturing step of removing or relieving a portion of only the front wall of each bag. The pack of bags of Kuklies, et al. does not provide for self-opening of the bags.

U.S. Pat. No. 4,877,473 to Snowden et al. discloses a pack of bags wherein the tearing line has a central arched portion which forms a sub tab. This sub tab can be easily grasped and pulled forward to pull the front wall of each bag to open that particular bag. However, each subsequent bag in the pack of bags must be opened in the same manner, and thus the desired self-opening feature is absent.

U.S. Pat. No. 5,087,234 to Prader et al. discloses an easy-open bag pack wherein the easy-open feature results from corona discharge treating a tube of polyethylene film, transverse sealing to form pillowcases of the plastic material, stacking the pillowcases, and applying sufficient pressure to a cutting device to form the handles therein.

U.S. Pat. No. 5,183,158 to Boyd et al. discloses a bag pack and dispensing system wherein the pack of bags has a self-opening feature, which arises out of frangible pressure bonding areas:located on the handles, distant the bag rack handle suspension slits, and both below the optional mouth tab and near the lower portions of the pack of bags, near its bottom edge. For a bag pack of the form of Boyd et al., without a suspension mouth tab, the reliability of the self-opening feature as each sucessive bag is pulled off the pack of bags may be compromised. For the bag packs of Boyd et al. with a suspension mouth tab, Boyd et al. teaches the preference of having its mouth tab's front side unattached to the back wall of the mouth tab. Front side free mouth tab structures are more difficult and costly to manufacture than conventional bag structure.

Despite the attempts to overcome the problems associated with these presently available bags, there remains a need for an improved pack of bags which (1) can be easily manufactured, yet which provides for reliable self-opening of each bag of the pack of bags, (2) does not leave a book of plastic tabs on the bagging rack, and (3) can be easily placed on a bagging rack.

SUMMARY OF THE INVENTION

The present invention overcomes the above noted deficiencies of the presently available bags by providing a new type of pack of self-opening bags and a bagging rack for use therewhich, which pack of bags has a self-opening feature that permits successive bags of the pack of bags to be self opened from the pack of bags.

The invention provides a pack of self-opening bags for use with a bagging rack having suspension arms, comprising:

a bag pack having a plurality of bags stacked in alignment, each of said bags having opposed walls with outer surfaces, and a pair of upwardly extending handles, each with a flapless bag handle suspension arm receiving aperture formed therethrough, said opposed walls being closed at a bottom edge and at least partially openable at a top to define a mouth region between said pair of upwardly extending handles, a mouth tab portion being located on said opposed walls of each of said bags in said mouth region of said bags, said mouth tab portion having at least one mouth tab aperture formed therethrough, said walls of the plurality of individual bags of said pack of bags. being held together by frangible bond means adjacent said flapless bag handle suspension arm receiving apertures and at least said one mouth tab aperture.

The invention further provides a flapless self-opening bag pack system comprising:

a bagging rack for mounting a pack of flapless self-opening bags and readying for loading individual bags from said pack of flapless self-opening bag, said rack comprising;

a base portion;

a rear wall portion extending upwardly from a rear region of said base portion, a pair of bag handle suspension arms, extending forwardly from an upper region of said rear wall portion over said base portion;

at least one upwardly and forwardly projecting bag tab mouth aperture engaging projection means; and a pack of flapless self-opening bags for use with said bagging rack, comprising;

a plurality of bags, aligned in a pack, each bag having a front wall and a rear wall;

side walls joining said front and rear walls, each bag being closed at a bottom edge;

a pair of integral handles extending upwardly from said top edge, with a mouth region located between said integral handles, each handle having a flapless handle aperture formed therethrough for receiving a bag handle suspension arm, with an area of frangible bonding means formed near a perimeter of said flapless handle aperture through the pack of bags; and mouth tab portions located on said front and rear walls in said mouth region of each said bag, said mouth tab portions having at least one mouth tab aperture passing through the pack of bags for receiving said bag pack mouth engaging projection means, wherein frangible bonding means are formed near at least a portion of the perimeter of the mouth tab apertures through the pack of self-opening bags.

The invention yet further provides a method for forming a pack of self-opening plastic bags having flapless handle apertures and mouth tab apertures mountable on a bagging rack, comprising the steps of:

stacking in alignment a plurality of flattened plastic bags sealed at top and bottom edges thereof;

providing dies having a forwardly lying sharp blade portion and a rearwardly lying blunt compression portion; and applying the dies to stack of flattened plastic bags such that the sharp blade portions cut through the stack of flattened plastic bags to form the flapless handle apertures and mouth tab apertures, and such that the blunt compression compresses layers of plastic of the bags together to thereby frangibly bond the stack of bags together in the vicinity of the flapless handle apertures and the mouth tab apertures.

The invention also provides dies for use in forming a pack of self-opening plastic bags having handle portions with a flapless handle apertures formed therethrough with a frangibly bound aperture perimeters area, and mouth tab portions with mouth tab apertures formed therethrough with a frangibly bound aperture perimeter area, said pack of bags being for use in conjunction with a bagging rack, said dies comprising:

a first die portion with a cutting edge for forming said handle aperture and said mouth tab aperture; and a compression portion with a generally blunt leading edge, positioned in close proximity to said first die portion, whereby when said die is applied to a pack of. bags, the first die portion will cut through the pack of bags, thereby forming the flapless handle apertures and mouth tab aperture, and the compression portion will compress together layers of plastic material of adjacent plastic bags in the pack of bags, thereby forming perimeter areas of frangible bonding.

The invention further provides pack of self-opening plastic bags adapted for use with a bagging rack. Each plastic bag optionally has an extension portion extending above an open mouth of the bag. At least one bag pack suspension aperture is formed at an upper region of the bag and is adapted for use in suspending the bag pack on a bagging rack. A carrying handle aperture (which can comprise the bag pack suspension aperture) is formed through an upper region of the bag pack. Areas of compression bonds are formed adjacent upper mouth regions of the bag pack, the handle carrying apertures, and/or the suspension aperture.

BRIEF DESCRIPTION OF THE DRAWINGS

FIG. 1 is a perspective view of a pack of self-opening bags of the invention;

FIG. 2 is a fragmentary perspective view of the upper area of a first embodiment of the pack of bags of FIG. 1, shown before the pack of bags is loaded on a bagging rack;

FIG. 3 is a partial perspective view of a die used to form circular apertures in the bag packs of FIGS. 1 and 2;

FIG. 4 is a partial cross-sectional view of the die through view lines 4—4 of FIG. 3;

FIG. 5 is a fragmentary perspective view of the upper region of a second embodiment of a pack of bags, shown before the pack of bags is loaded on a bagging rack;

FIG. 6 is a fragmentary perspective view of the upper region of a third embodiment of a pack of bags, shown before the pack of bags is loaded on a bagging rack;

FIG. 7 is a perspective view of the die used to form the frangibly bond slits of the third embodiment of the pack of bags of FIG. 6;

FIG. 10 is a perspective view of the first embodiment of the pack of bags of FIG. 1 hanging on a bagging rack of the invention, before an individual bag is readied for loading with merchandise;

FIG. 22 is a ninth embodiment of a pack of self-opening plastic bag pack of the invention.

FIG. 23 is detail of the upper region of the bag design of FIG. 22.

DESCRIPTION OF THE PREFERRED EMBODIMENT

Figure 8:
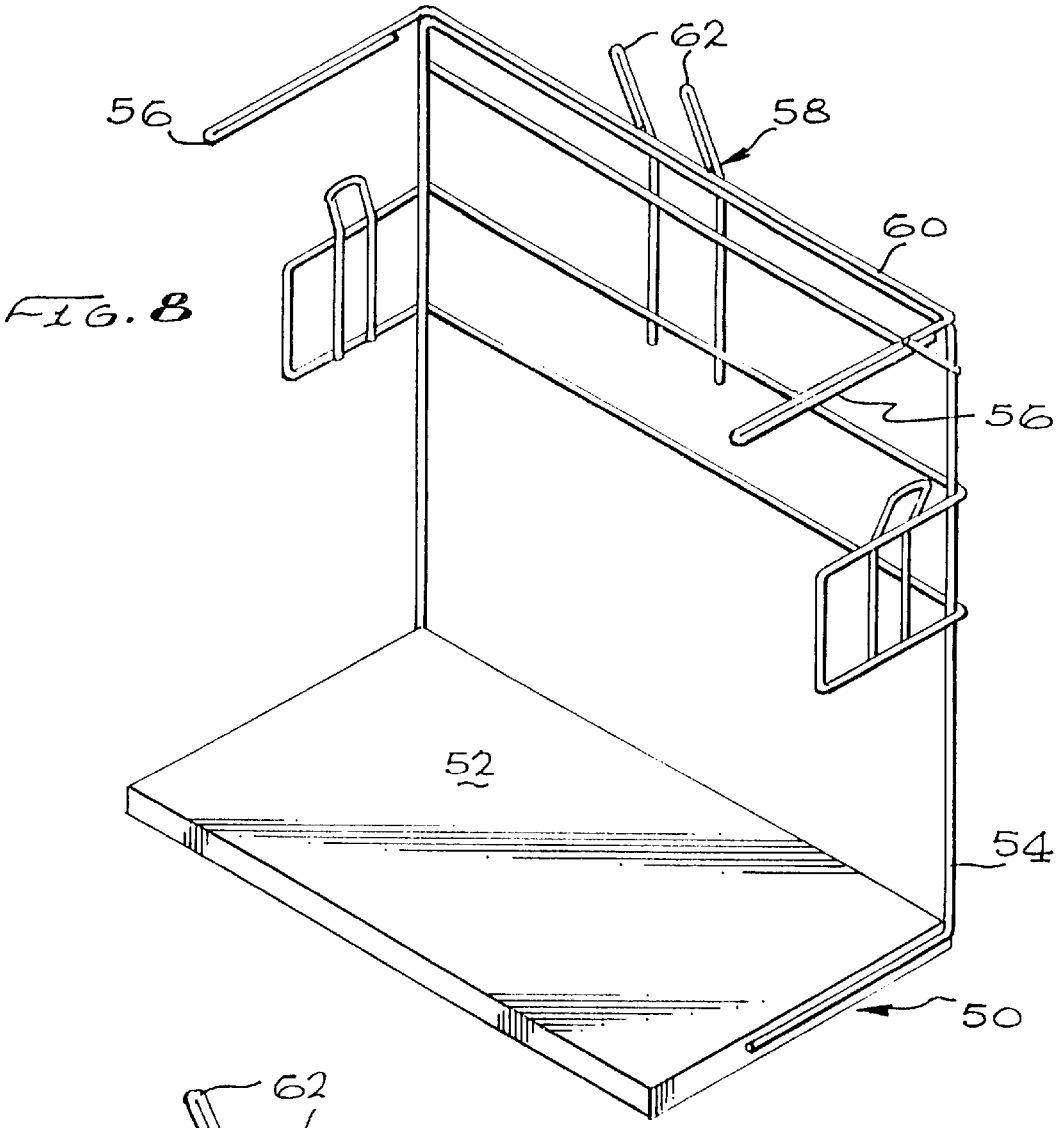
FIG. 8 is a perspective view of a bagging rack of the self-opening bag pack system of the invention.

Referring now more specifically to the drawings, reference numeral. 10 designates the self-opening bag pack formed in accordance with the invention of multiple individual bags 12. Referring to FIGS. 1, 2 11, 13, each individual bag 12 has a lower body portion 14 with two loop handles 16 extending upwardly from the lower body portion 14, at opposite sides of the bags 12, with a mouth 18 thereby defined therebetween. The individual bags 12 each have a front wall 20, and a rear wall 22 joined together by pleated side walls 24. The T-shirt bags 12 are sealed together at their bottom edges 26 to form the lower body portion 14 and at their top edges 28 to form the loop handles 16. Heat seaming is the preferred method of sealing the bottom and top edges 26 and 28 of the bags 12, but other means can be employed, if desired. A mouth tab portion 30 extends upwardly from the top edges 32 of the front and rear walls 20 and 22 at the mouth 18 of the bags 12 between the two loop handles 16.

The mouth tab portion 30 in the embodiment of FIGS. 1, 2 and 10–13 preferably has two flap portions 32, each having a mouth hole 34 passing through the pack of self-opening bags 10. Surrounding at least a portion of the perimeter of the mouth holes 34 are areas of frangible cold pressure bonding 36 which frangibly bonds together adjacent layers of the plastic material of the bags 12 in the pack of self-opening bags 10. A tear initiating nick 38 is made at the upper portion of the flap portions 32, which nick 38 communicates with the mouth holes 34.

It is preferable for the area of the frangible bonding 36 not to impinge on the area of the perimeter of the mouth holes 34 through which the tear initiating nick 38 passes. As will be discussed further below, these mouth holes 34 are used to suspend the pack of bags 10 on a bagging rack 50.

The mouth tab portion 30 has a thumb notch relief area 44 between the two flap portions 32. The thumb notch relief area 44 permits the box person to easily pull open the first bag 12 in the pack of bags 10 to thereby initiate the self-opening feature of the pack of bags 10. The advantage of the two mouth hole 34 embodiment is that if the pack of bags 10 inadvertently tears through the mouth tab portion 30 at one mouth hole 34, the pack of bags 10 will still have another intact mouth hole 34 from which to hang it on the bagging rack 50.

The pack of self-opening bags 10 also have handle holes 40 passing through the handles 16 for use in suspending the pack of self-opening bags 10 on a bagging rack 50. These handle holes 40 have areas of frangible cold pressure bonding 42 around at least a portion of the perimeter of the handle holes 40. As in the case of the mouth holes 34 formed through the mouth tab portion 30, the frangible bonds 42 around the perimeter of the handle holes 40 frangible retain the layers of plastic material of the handles 16 of the pack of bag 10 in stacked alignment. The handle holes 40 do not have flaps which could interfere with the easy placement of a pack of bags 10 on a bagging rack 50.

The pack of self-opening bags 10 of the invention is designed to be used in conjunction with a bagging rack 50, such as that shown in FIG. 8. The bagging rack 50 has a support base 52, an upwardly extending rear wall portion 54, and two bag pack handle suspension arms 56 extending forwardly over the support base 52 from the rear wall portion 54. A bagging pack hook member 58 extends above a top edge 60 of the rear wall 54 and preferably projects upwardly and forwardly therefrom at an acute angle. The bagging rack hook member 58 is positioned approximately midway on the top edge 60 between the two bag pack handle suspension arms 56. The bagging rack hook member 58 has a pair of projections 62 which are spaced apart and project upwardly and preferably forwardly over the support base 52, such that the pack of self-opening bags 10 can be placed on the bagging rack 50 by looping the mouth holes 34 of the mouth tab portion 30 of a pack of self-opening bags 10 over the projection 62, as shown in FIGS. 10–13.

Figure 9:
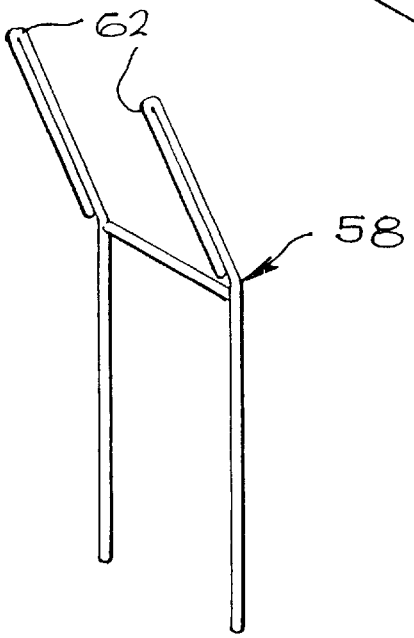
FIG. 9 is a perspective view of a mouth tab aperture engaging hook of the bagging rack.

FIG. 9 is a perspective view of one possible embodiment of the bagging rack hook member 58 with a pair of spaced apart projections 62, which can be affixed to a conventional bagging racks, without a pair of upwardly and forwardly projecting projections (not shown), to convert it to the bagging rack of FIG. 8.

The manufacturing process employed to manufacture the pack of self-opening bags 10 of the invention is similar to that used to manufacture conventional T-shirt bags, and does not require any additional steps. The advantages of the bag pack 10 of the invention derives from its design and the design of the dies used to form the frangibly bound perimetered mouth holes 34 and handle holes 40 in the pack of self-opening bags 10, as will now be discussed in detail.

Referring to FIGS. 3 and 4, the die portion 64 used to form the mouth holes 34 is unique, and creates the cold pressure frangible bonding 36 (See FIG. 2) which is necessary to provide the self-opening feature of the pack of self-opening bags 10. The die portion 64 has a cylindrical cutting portion 66 with a terminating sharp cutting edge 68. A blunt sleeve member 70 surrounds at least a portion of the outer perimeter of the cylindrical cutting portion 66 around its outer perimeter. The generally blunt leading edge 72 of the sleeve member 70 is set back slightly rearwardly from the cutting edge 68. The sleeve member 70 is preferably affixed directly adjacent to the cylindrical cutting portion 66, as by soldering, adhesives or welding, but can also be spaced slightly away from the outer perimeter of the cylindrical cutting portion 66. A nicking blade portion 76 is attached to the cylindrical cutting portion 66 and has a cutting edge 78 which is generally flush with the cutting edge 68 of the cylindrical cutting portion 66. It is this nicking blade portion which makes the tear initiating nick 38 in the pack of self-opening bags 10. The cylindrical cutting portion 66 is used to form the mouth holes 34 in the mouth tab portion 30. The blunt edge sleeve member 70 is used to form the frangible cold pressure bonds 36 surrounding the mouth holes 34.

The die used to form the handle holes 40 and the surrounding area of frangible cold pressure bonding 42 (not shown) in the perimeter region of the handle holes 40 is almost identical to the die portion used to form the mouth holes 34, except that it does not have a nicking blade portion 76, and its blunt sleeve member 70 used to form the frangible cold pressure bonding 42 around the handle holes 40 may surround the entire perimeter of the handle holes 40.

The die portion 64 is affixed to a die support plate 80, which die support plate 80 also carries other die member (not shown) which are used to cut the other feature (i.e. the handles, mouth and mouth tab portion) from the stack of pillowcases from which the pack of self-opening bags 10 is ultimately formed. When the die portion 64 and stack of pillowcases are brought into contact with each other, the cutting edge 68 of the cylindrical cutting portion 66 and the cutting edge 78 of the nicking blade portion 76 cleanly cut the mouth holes 34 and the tear initiating nicks 30, respectively, while the blunt leading edge 72 of the set back sleeve member 70 compresses the stacked layers of plastic around the perimeter of the mouth holes 34 under great pressure. This pressure causes the adjacent layers of plastic of the multiple stacked bags 12 to be compressed together, thereby forming the area of slight frangible bonding 36 between the layers of plastic around the mouth holes 34. This frangible bonding 36 not only contributes to the self-opening feature of the pack of bags 10, but also ensures that the thusly formed pack of bags 10 is retained in stacked alignment for easy loading on the bagging rack 50. The degree of frangible bonding can be increased by enlarging the surface contact area of the leading edge of sleeve member 72, such as by increasing the thickness of the blunt sleeve member 70 and/or by increasing the extent to which it surrounds the entire cylindrical cutting portion 66.

The handle holes 40 are formed in an equivalent manner, except that the die used to form the handle holes 40 will form no tear initiating nicks adjacent the handle holes 40 in the pack of self-opening bags 10.

FIG. 5 shows an alternate embodiment of a self-opening bag pack 90, wherein the mouth tab portion 92 has a single mouth hole 94 with a frangibly cold pressure bonded perimeter 96, and a tear initiating nick 98. The handle holes 100 have a frangibly cold pressure bonding perimeter area 102. The bagging rack for use with this embodiment will be similar to that shown in FIGS. 8 and 9, except that it has a bagging rack hook with a single mouth tab aperture receiving projection (not shown).

FIGS. 6 and 7 show a third embodiment of a pack of bags 110 of the invention, and the die member 122 used to form its frangibly bond slits 112 and 114, respectively.

In the embodiment of FIG. 6, instead of mouth holes and handle holes, mouth tabs slits 112 and handle slits 114 with areas of frangible cold pressure bonding 116 are used to hang the pack of bags 110 on the bagging rack 50. For the mouth tab portion 118, the frangible cold pressure bonding 116 can be formed on one or both sides of the mouth slit 112, as desired.

To prevent the handle slits 114 from tearing through the handles 16, tear guard slits 120 are located above and below the handle slits 114. These tear guard slits 120 are generally semi-circular in shape and are oriented to concavely face the handle slits 114. If for some reason the handle slits 114 are caused to tear through the handles 16 and propagate beyond their original position, then the lengthened handle slit 114 will intersect one or both tear guard slits 120, and thereby stop. The handle slit inwardly facing curvature of the tear guard slits 120 is designed to direct any tearing force which may be present inwardly towards the handle slits 114. If desired; areas of cold pressure frangible bonding 116 can be formed on the sides 121 of the tear guard slits 120 furthest from the handle slits 114.

The mouth slits 112, handle slits 114, and tear guard slits are formed with a die member 122 which has blade portion 124 having a sharp cutting edge 126, which cuts the slits 112, 114 and 120, and an adjacent blunt compression portion 128, with its generally flat leading edge 130 set back slightly from the sharp cutting edge 126 of the blade portion 124. The blade portion 124 and blunt compression portions are preferably permanently affixed together by soldering, spot welding, adhesives, or other known means, but can also be spaced slightly apart. The die member 122 is affixed to a mounting surface 132.

Referring to FIGS. 10–13, a pack or packs of self-opening bags 10 of FIG. 1 are placed on the bagging rack 50 by passing the handle holes 40 in the handles 16 over the bag pack handle suspension arms 56 of the bagging rack 50 and then engaging the mouth holes 34 of the mouth tab portion 30 with the projections 62 of the bagging rack hook member 38 on the rear wall portion 54.

Figure 11:
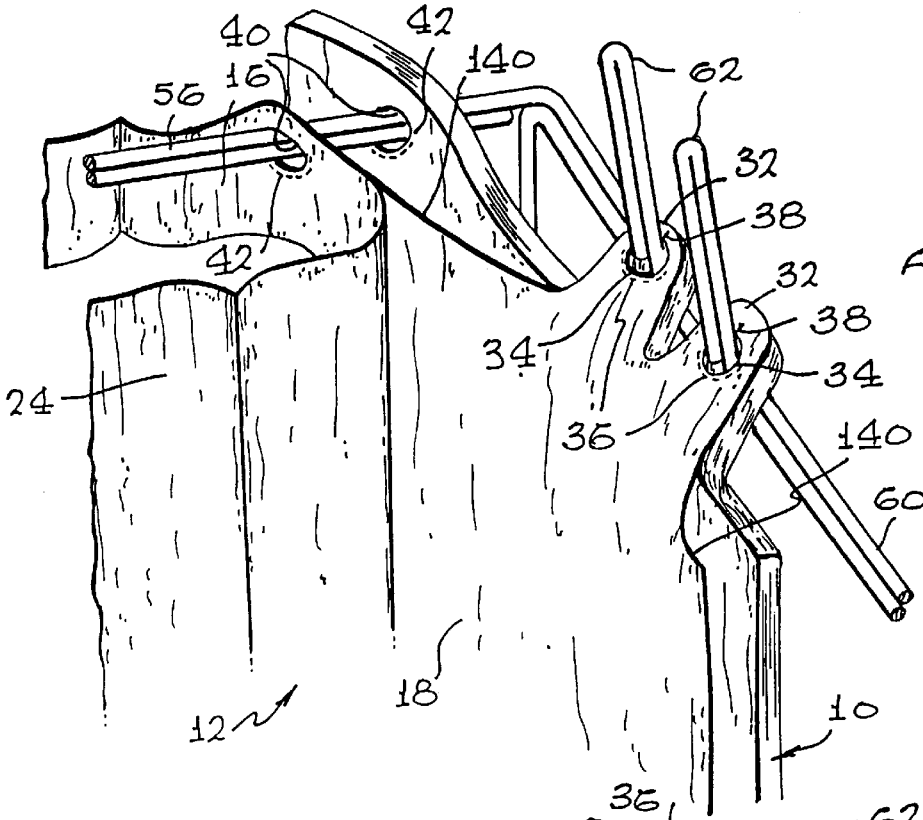
FIG. 11 is a partial perspective view of the first embodiment of the pack of bags of FIG. 1 hanging on the bagging rack of the invention, as a topmost bag is first opened up and released from the pack of bags.

Referring to FIG. 11, after loading a new pack or packs of self-opening bags 10 on the bagging rack 50, the checkout clerk or box person first grasps only the front wall 20 of the topmost bag 12 and pulls it forwardly to open the mouth 18 of the bag 12. The front wall 20 only of the topmost bag 12 will be torn free from the pack of self-opening bags 10 at its mouth tab portion 30 by virtue of the tear initiating nick 38 ripping through the mouth tab portion 30. The rear wall 22 of the top bag 12 will stay attached to the bagging hook member 58. After the topmost bag 12 is loaded with merchandise, its handles 16 are disengaged from the bag pack handle suspension arms 56 of the bagging rack by pulling the bag forwardly, and the loaded bag 12 is removed from the bagging rack 50. This action causes only the front wall 20 and side wall 24 of the next bag 12 in the pack of self-opening bags 10 to be pulled forward and automatically opened without any need for the checkout clerk or box person to grasp the material of the front wall 20 of the bag 12.

The self-opening feature of the pack of bags 10, and the consistency thereof, arises out of the frangible bonding 36 and 42 formed along the perimeters of the mouth holes 34 and handle holes 40.

The mechanics of the self-opening feature is described below, with reference to the pack of bags 10 of FIGS. 1 and 2 hanging on a bagging rack 50 of the kind shown in FIGS. 8 and 10. The self-opening mechanics will be the same for other styles of packs of self-opening bags 90 and lo of FIGS. 5 and 6, respectively.

Figure 13:
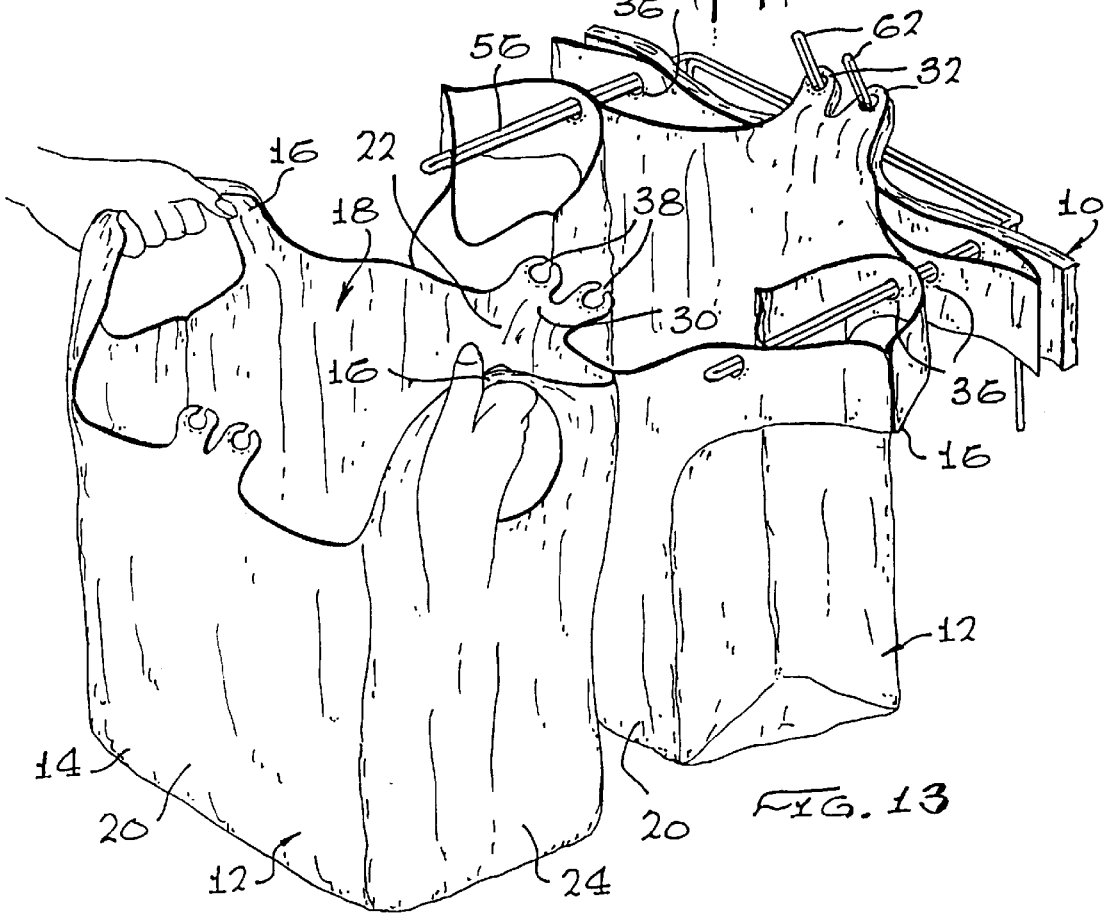
FIG. 13 is a further perspective view of the bag and pack of bags of FIG. 12 as the top bag is completely removed from the bagging rack and the next bag is automatically readied for loading.
Figure 12:
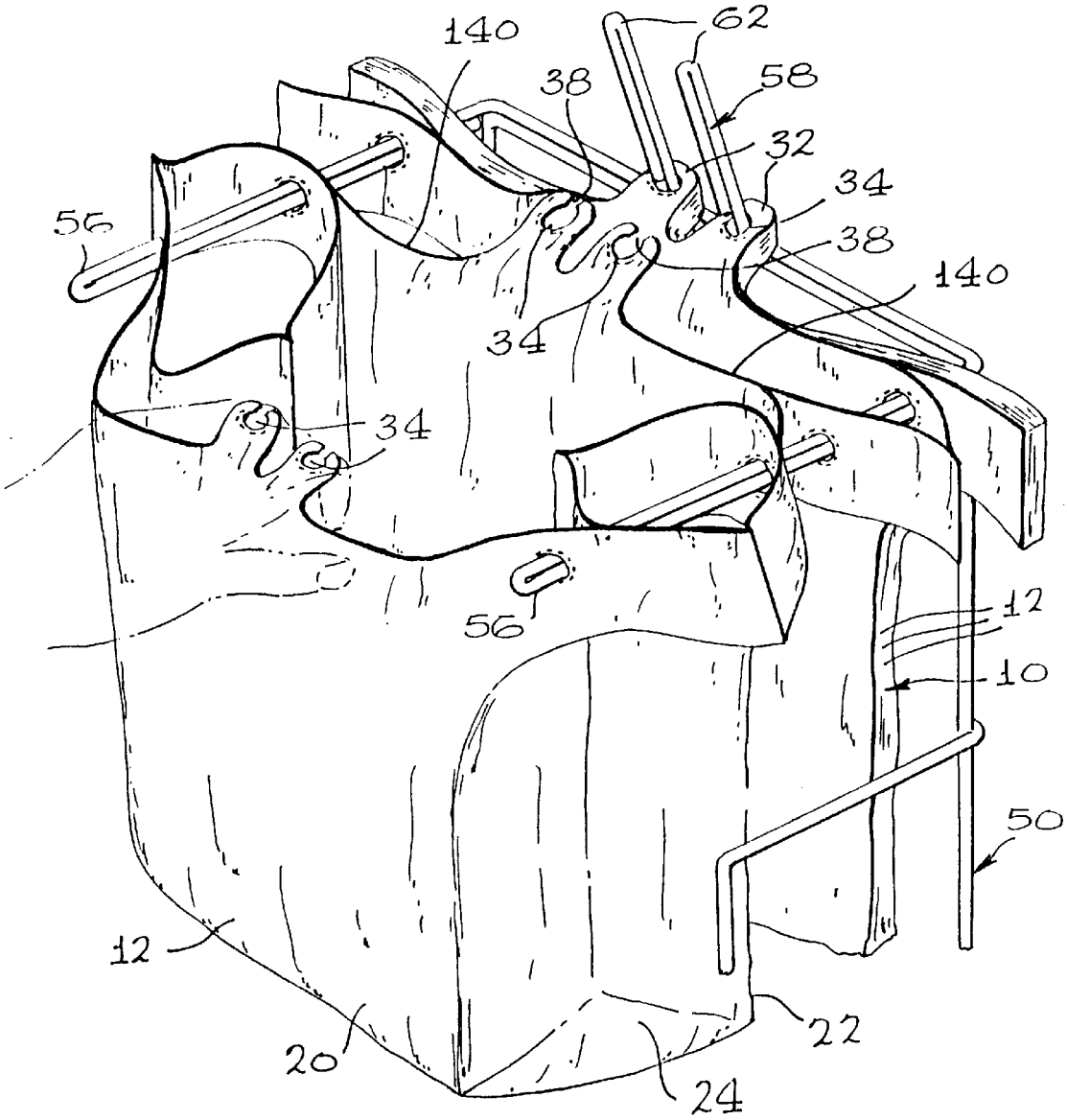
FIG. 12 is a perspective view of the bagging rack loaded with bags of FIG. 1, shown with the topmost bag of the pack of bags torn free from the tab hook of the bagging rack and opened up for loading with merchandise.

As best shown in FIGS. 11 to 13, when the forwardly lying bag 12 is pulled forwardly to disengage it from the pack of self-opening bags 10, most of the forward pulling tension will be delivered along the top edges 140 of the bag's mouth 18 to the top region of the mouth holes 34, in the region of the tear initiating nick 38. This pulling tension causes the rear wall 22 of the top bag 12 and the front wall 20 of the next bag 12 to tear free from the pack of self-opening bags 10 at their mouth tab portions 30, along the tear initiating nick 38, leaving no portion of the bag 12 on the bagging rack 50. Because of the frangible bonding 42 of the front and rear walls 20 and 22 of adjacent bags 12 around the handle holes 40, and the slight adhesion between these layers of plastic material along the areas of frangible bonding 42, the action of pulling the front bag 12 will also pull forward only the front wall 20 of the immediately following bag 12, resulting in the next bag 12 in the pack of self-opening bags 10 opening up. Thereafter, by merely withdrawing consecutive bags from the top of the pack of self-opening bags 10 the bags 12 immediately following will open up without the box person needing to manually and individual disconnect just the front wall of material 20 of the topmost bag 12.

The ripping through of the tear initiating nicks 38 happens prior to the destruction of the frangible pressure bonding 36 surrounding the mouth holes 34, so the pulling tension caused by pulling a bag 12 off the rack 50 will cause the next bag 12 in the pack of self-opening bags 10 to open up. Thereafter, very slight pulling of the frontmost bag 12 will separate it from the next bag 12 which still is frangibly bonded to it around the mouth holes 34 and/or handle holes 40.

It is important that the pack of self-opening bags 10 be retained on the bagging rack 50 at its mouth tab portion 30, otherwise the pulling tension will tend to pull the entire pack of self-opening bags 10 forwards, which interferes with the efficient self-opening function.

While the self-opening bag packs 10 has been described with respect to the embodiments of FIGS. 1, 2, 5 and 6, other embodiments, having bag handle apertures and mouth tab apertures other than in the form of circular holes and slits can be utilized.

As can be appreciated, the self-opening feature of the pack of self-opening bags 10 is accomplished by a simple and reliable method of manufacture.

Figure 14:
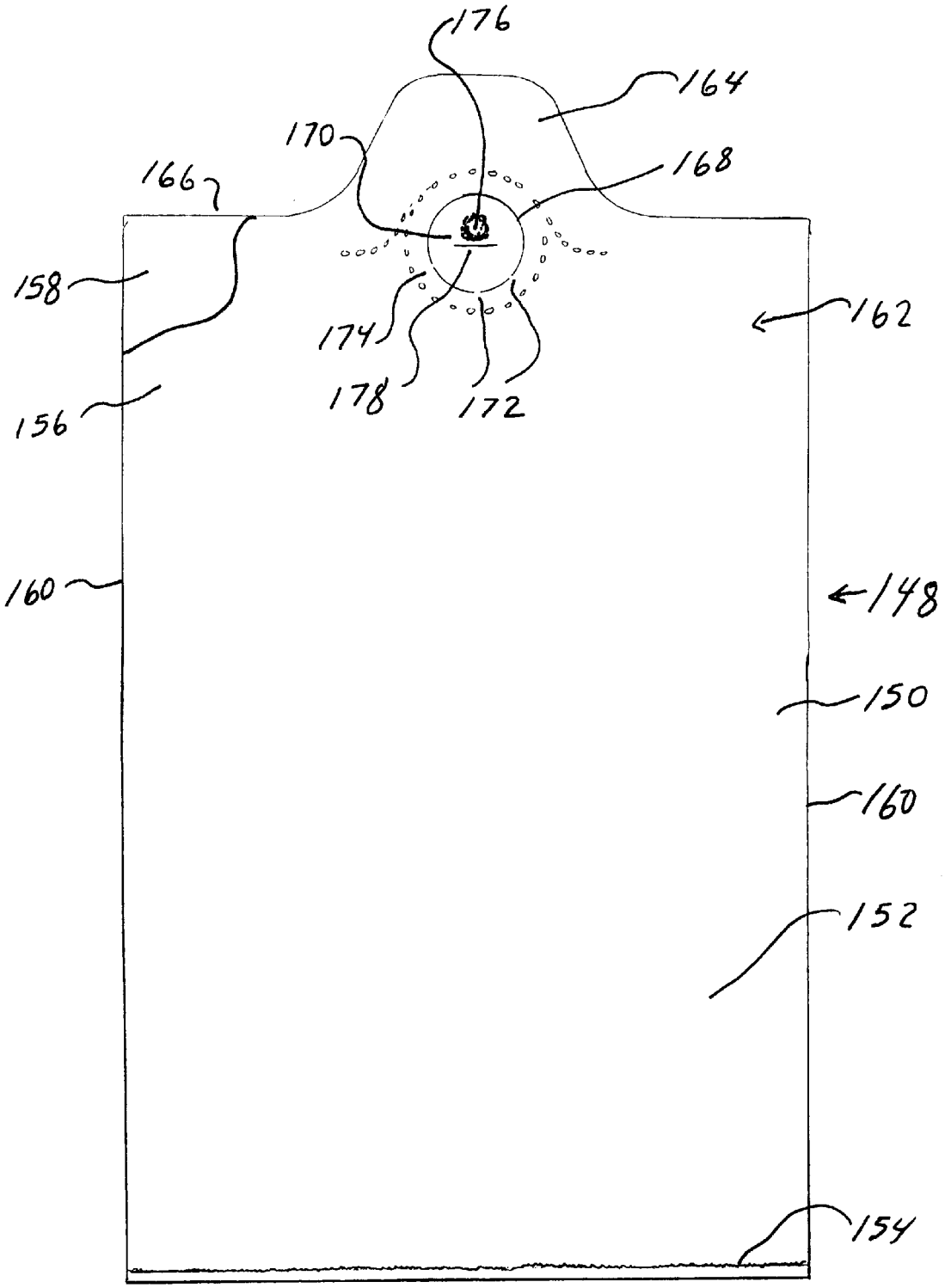
FIG. 14 is a top plan view of a fourth embodiment of a pack of self-opening plastic merchandise bag pack of the invention.
Figure 15:
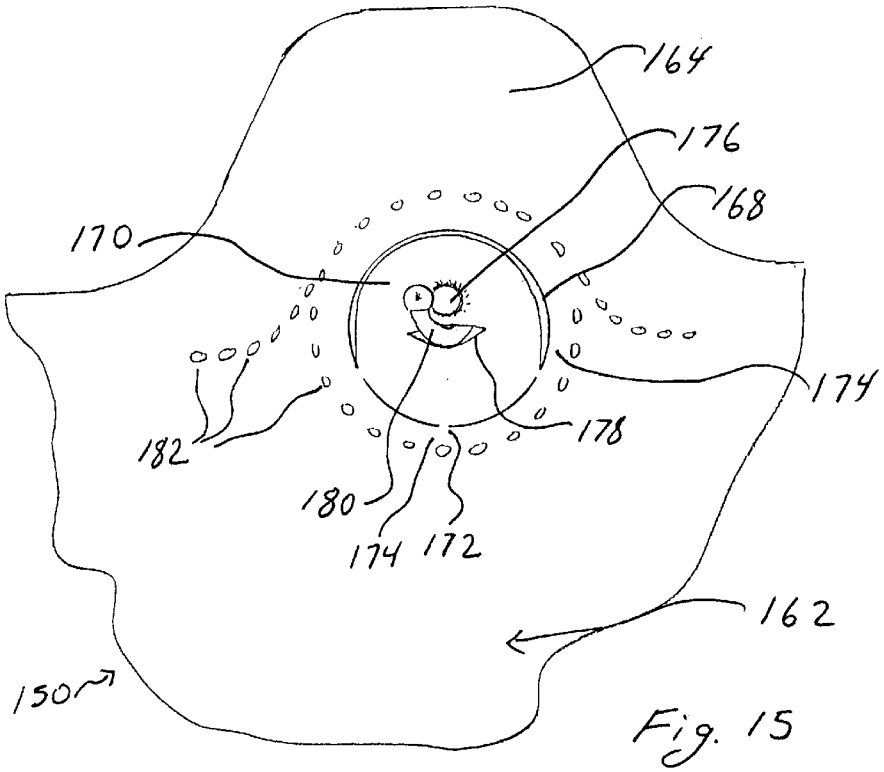
FIG. 15 is a detail of the center upper region of the bag pack of FIG. 14, retained on a hook of a bagging rack.

Referring to FIGS. 14 and 15, views of a fourth embodiment of self-opening plastic merchandise bag pack 148 of the invention is shown comprises of a plurality of bags 150 stacked in registration and frangibly attached together. Each plastic bag 150 in pack of bags 148 has a lower bag portion 152 closed at a bottom edge 154 and has front and rear walls, 156 and 158, respectively. These bags 150 can be pleated along sides 160 (not shown.) Bags 150 are typically formed of continuous tube material, but likewise can comprise sheet material also seamed together along side edges 160 (not shown.) At an upper region 162 of bags 150 there are preferably extension portions 164 which extend above an upper edge 166 of bags 150 from front and rear walls 156 and 158 thereof. At least one bag pack suspension aperture 168 is formed in an upper region of bag 162 and/or partially or completely in extension portions 164. As shown in FIGS. 14 and 15, a relatively large detachable flap 170 can be formed within bag pack suspension aperture 168, and is preferably detachably attached therewithin with at least one uncut webs 172 to perimeter areas 174. Detachable flaps 170 are preferably affixed together as a "book" of flaps with a hot pin or a welded hole 176. A suspension aperture 168 is preferably formed though detachably flap 170, and can comprise a slit 178 (shown), hole, or another smaller flap (not shown.) Alternately, suspension aperture 168 can also incorporate welds (not shown.)

Referring to FIG. 15, a detail is shown of upper portion of bag pack 150 suspended at its upper region 162 on a bagging rack's hook member 180. Located in upper region 162 of bag pack are areas of frangible compression bonding 182. These areas of frangible compression bonding 182 preferably are located at least partially around suspension aperture 168 and preferably laterally as well. When a single bag 150 is removed from pack of bags 148 webs 172 joining detachable flaps 170 to perimeter area 174 tear through, leaving detachable flaps 170 from removed bag 150 on book of detachable flaps 170 retained on hook member 180 of bagging rack. Suspension aperture 168 is preferably sized sufficiently large such that when bag 150 is removed from pack of bags 148 (detaching detachable flap 170), suspension aperture 168 can serve as a carrying handle for bag 150. As with other embodiments of bags disclosed above, areas of compression frangible bonds 182 act to frangibly bond together the outside surfaces of front and rear walls 156 and 158, respectively, of adjacent bags. By pulling a frontmost bag open, the rear wall 158 of the front bag 150 (still frangible bonded to the front wall 156 of the following bag 150) will pull open the front wall 156 of following bag 150 in pack of bag 148. This opens and readies the next bag 150 in pack 148 for immediate use. While suspension aperture 168 is shown as generally circular, it can assume a variety of shapes, including ovals, triangles, rectangles, or other desired shapes. Also, while suspension aperture 168 is shown as being partially located in extension portions 164 (to enhance the usable storage volume of lower bag portion 152), suspension aperture 168 can be completely located in extension portions 164, or extension portions 164 can be eliminated as shown in the bag designs of FIGS. 24 and 25, discussed below. An advantage of incorporating a detachable flap 170 in aperture 168 (with a smaller suspension aperture 178 formed in detachable flap 170) is that smaller suspension aperture 178 will prevent bag pack 148 from shifting around on hook 180 of a bagging rack. When bag is pulled off of bagging rack, detachable flap 170 will be removed, leaving a large hole, which hole can be used as a carrying handle for the bag 150.

Figure 16:
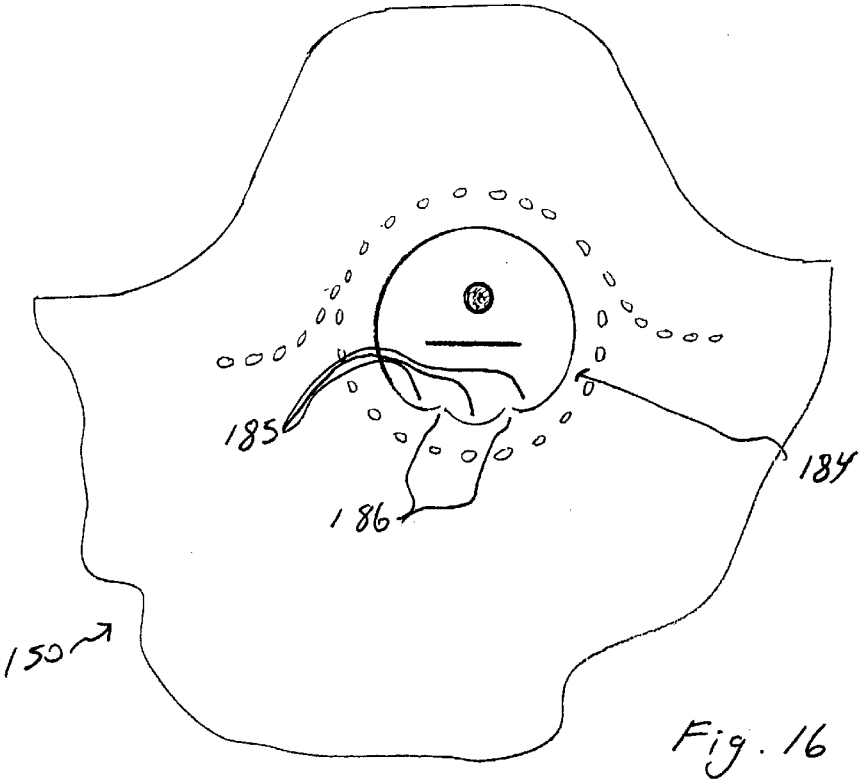
FIG. 16 is a detail of an alternate embodiment of the center upper region of the bag pack of FIG. 14.

Referring to FIG. 16, there is shown a detail of a modified version of the suspension aperture of bag pack 150. In this embodiment, rather than being circular, suspension aperture 184 has lobe portions 185 (that have a smaller radii of curvature that the rest of the aperture) adjacent uncut webs that curve inwardly adjacent web portions 186 where the flaps are joined to upper region of bags. With this design, any possible tear initiation adjacent the web portions 186 will be directed inwardly into suspension aperture 184.

Figure 17:
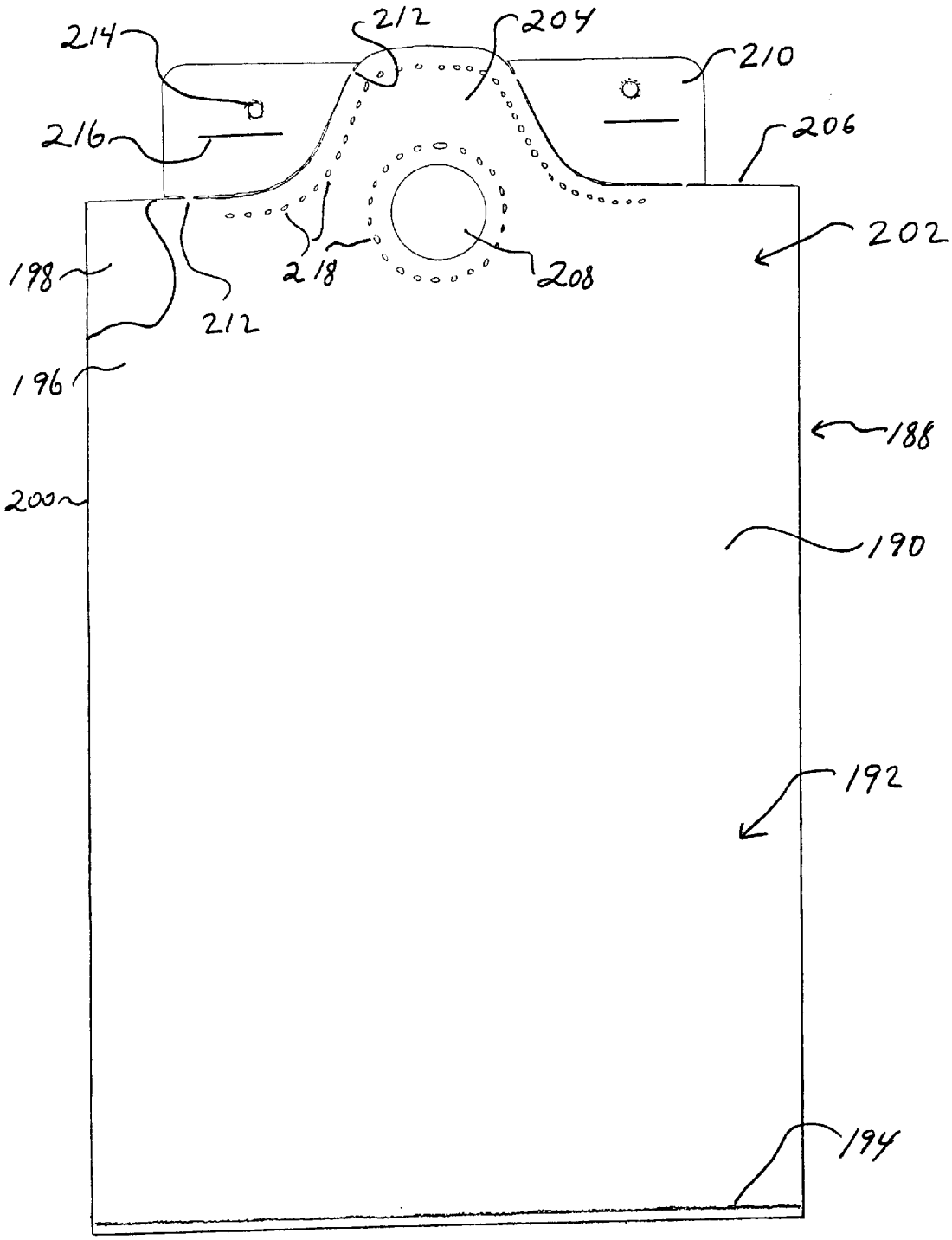
FIG. 17 is a top plan view of a fifth embodiment of a pack of self-opening plastic merchandise bag pack of the invention.

Turning to FIG. 17 there is shown a fifth embodiment of a pack of self-opening plastic merchandise bag pack 188. The fifth embodiment of a pack of self-opening plastic merchandise bag pack 188 is similar to the pack of self-opening plastic merchandise bag pack 148 of the fourth embodiment. Each plastic bag 190 in pack of bags 188 has a lower bag portion 192 closed at a bottom edge 194 and has front and rear walls, 196 and 198, respectively. These bags 190 can be pleated along side 200 (not shown.) Bags 190 are typically formed of continuous tube material, but likewise can comprise sheet material also seamed together along side edges 200 (not shown.) At an upper region 202 of bag 190 there are preferably extension portions 204 which extend above an upper edge 206 of bag 148 from front and rear walls 196 and 198. Unlike the pack of the fourth embodiment, no flap is formed in handle aperture 208. Instead, detachable ears 210 extend from upper edges 206 of bag and along both sides of extension portion 204. Ears 210 are detachably affixed to front and rear walls 196 and 198 of bags at upper region 202 and to extension portion 204 via uncut web areas 212. Stacks of ears 210 are preferably permanently attached together into books. This can be accomplished with welds 214. Suspension aperture 216 are also formed through ears 210, and can comprise a slit 216 (shown), hole or another smaller flap (not shown.) Suspension aperture 216 can incorporate welds to form a book of ears 210. Pack of bags 188 can be suspended on hooks of a bagging rack on suspension aperture 216 (not shown.) Located in upper region 202 of bag pack 188 are areas of frangible compression bonding 218. These areas of frangible compression bonding 218 preferably surround at least a portion of handle aperture 208, and are also preferably located adjacent a perimeter of extension portion 204 and/or upper edges 206 of bag 190. When a single bag 190 is removed from pack of bags 188, webs 212 tear through, leaving ears 210 from removed bag 190 on book of detachable ears 210 retained on hook member of bagging rack. Handle aperture 208 is preferably sized sufficiently large to act as a carrying handle for bag 190. Areas of compression frangible bonds 218 frangibly bond together the outside surfaces of front and rear walls 196 and 198, respectively, of adjacent bags. By pulling a frontmost bag open, the rear wall 198 of the front bag 190 (still frangible bonded to the front wall 196 of the following bag 190) will act to automatically open the following bag 190 in pack of bag 188. While handle aperture 208 is shown as generally circular, it can assume a variety of shapes, including ovals, triangles, rectangles, or other desired shapes. Also, while handle aperture 208 is shown as being partially located in extension portions 204 (to enhance the usable storage volume of lower bag portion 192), handle aperture 208 can be completely located in extension portions 204 or extension portion 204 can be eliminated.

Figure 18:
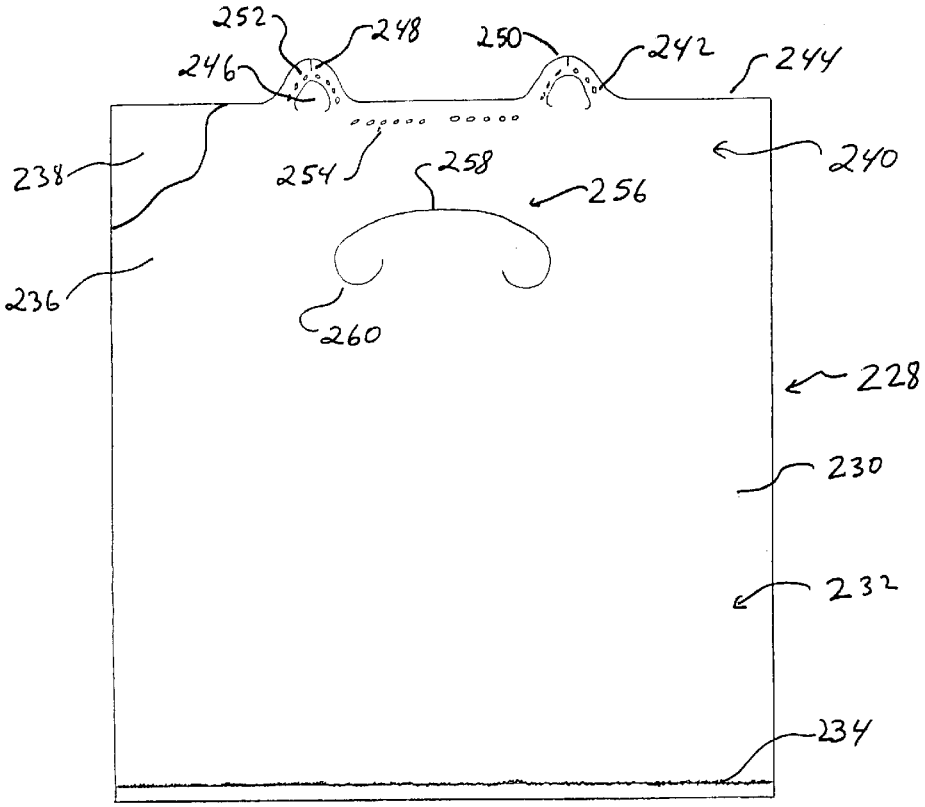
FIG. 18 is a top plan view of a sixth embodiment of a pack of self-opening plastic merchandise bag pack of the invention.

Referring to FIG. 18 there is shown a top view of a sixth embodiment of self-opening plastic merchandise bag pack 228 comprises a stack of bags 230 frangibly retained together in registration. Bags 230 have a lower bag portion 232 closed at a bottom edge 234 and have front and rear walls, 236 and 238, respectively. At an upper region 240 of bag 230 there are preferably extension portions 242 which extend above an upper edge 244 of bag 230 from front and rear walls 236 and 238. Apertures 246 are formed in extension portions 242. A tear initiating slit 248 is formed in each aperture extension, preferably extending from a topmost edge 250 of extension portions 242, and extend downwardly toward, but not in contact with aperture 246. Aperture 246 can have a flap or can be flapless. Frangible bonding areas 252 are preferably formed through extension portions 242 in bag pack 230 adjacent aperture 246. Additional areas of frangible bonding 254 are preferably located through upper region 240 of bag pack. A handle aperture 256 is formed in upper region of bag pack 240. While handle aperture 256 can assume any number of shapes, an upwardly curved center cut-line portion 258, with inwardly and upwardly curved end cut portions 260 provides a useful shape, with the upwardly curved end portions 260 providing for tear resistance in the handle area. Even if there is tearing initiated at end portions 260, such tearing would be propagated into handle aperture 256 without destroying bag integrity. As with the other styles of bag packs, the areas of frangible compression bonds 252 and 254 frangibly bond together the outside surfaces of front and rear walls 236 and 238, respectively, of adjacent bags. By pulling a frontmost bag open, the rear wall 238 of the front bag 230 (still frangible bonded to the front wall 236 of the following bag 230) will act to pull open the front wall 236 of following bag 230 in pack of bag 228, automatically reading it for use.

Figure 19:
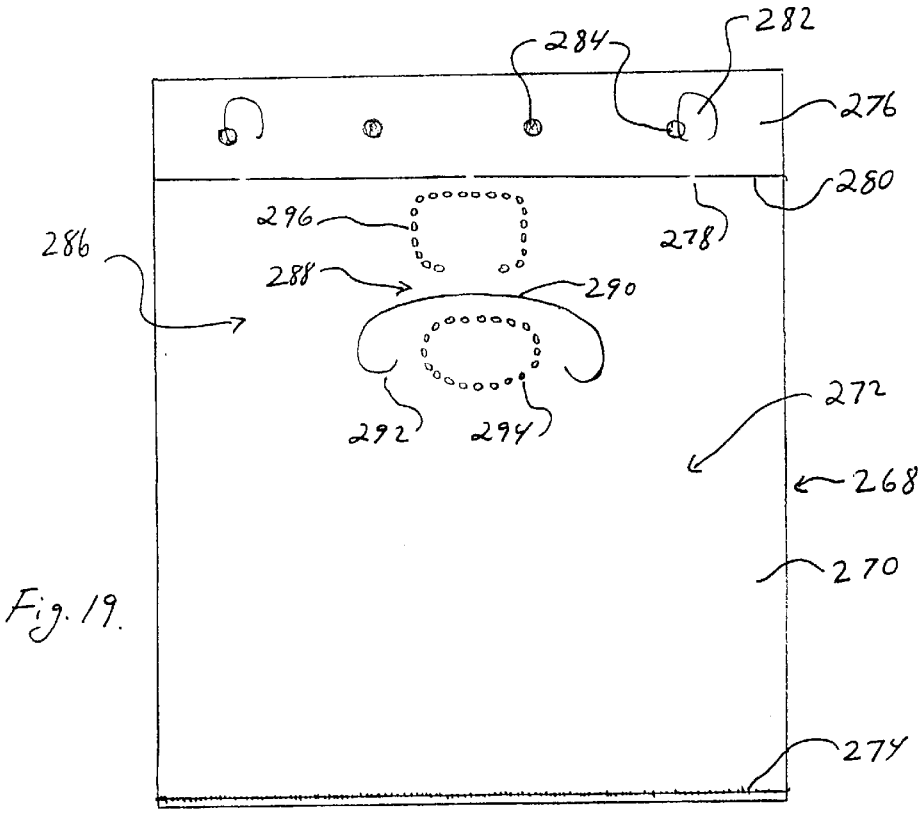
FIG. 19 is a top plan view of a seventh embodiment of a pack of self-opening plastic merchandise bag pack of the invention.

Referring to FIG. 19, a seventh embodiment of a pack of self-opening plastic merchandise bag pack 268 comprises a stack of bags 270 frangibly retained in registration. Each bag comprises a lower bag portion 272 sealed at a bottom edge 274, and a header portion 276 attached with webs 278 to upper edge 280. Suspension apertures 282 are formed through header portion 276. Header portions 276 of pack of bags 268 are permanently retained together with means, such as welds 284. Located in upper region 286 of bag is a handle aperture 288. While handle aperture 288 can assume any number of shapes, an upwardly curved center cut-line portion 290, with inwardly and upwardly curved end cut portions 292 provides a useful shape, with the upwardly curved end portions 292 providing for tear resistance. Frangible bonding areas 294 are preferably formed in the vicinity of handle aperture 288 and/or frangible bonding areas 296 are formed between handle aperture 288 and below upper edge portion 280. Frangible bonding areas 294 and/or 296 frangibly bond together walls of adjacent bags and create the self-opening feature.

Figure 20:
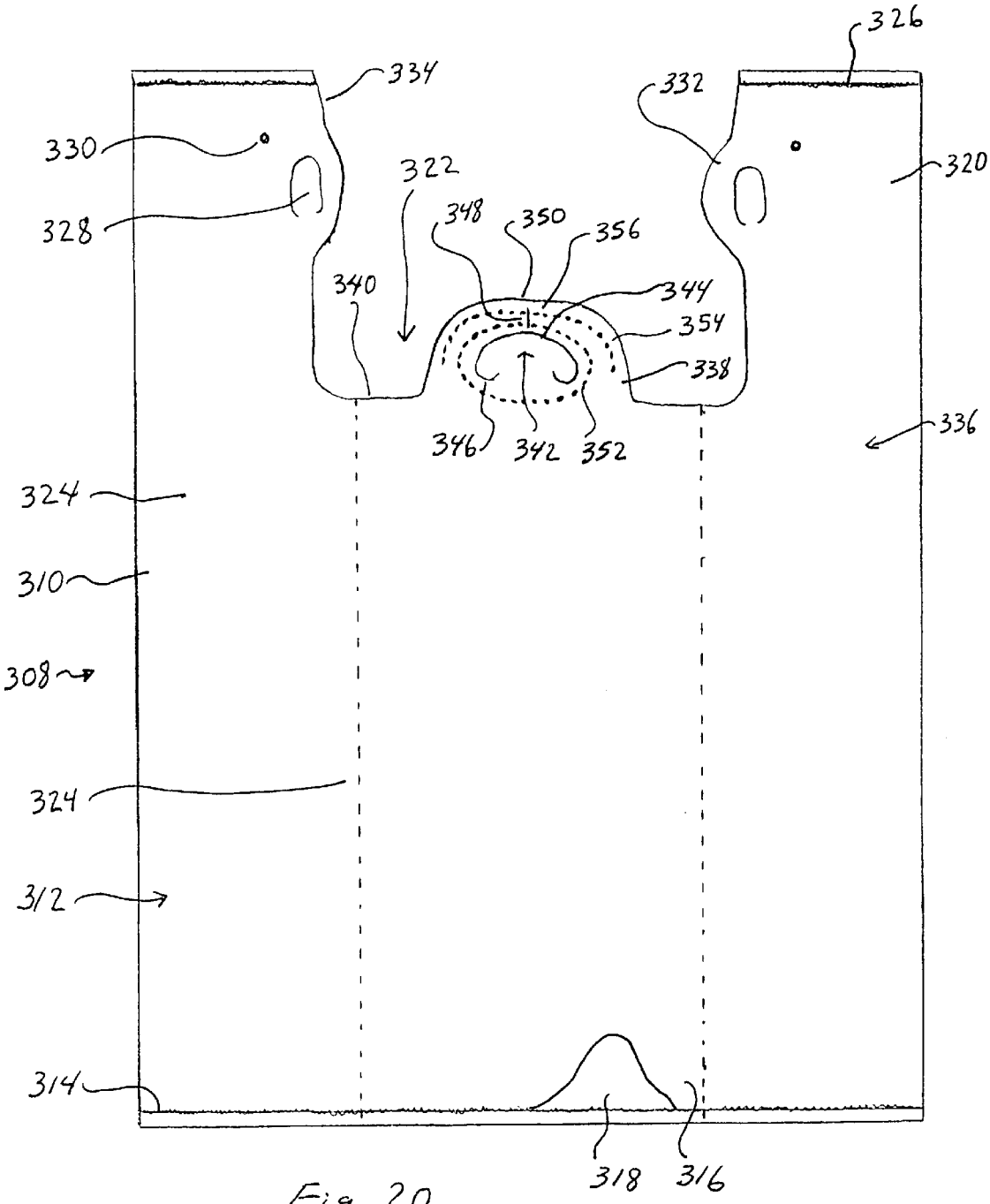
FIG. 20 is a top plan view of an eight embodiment of a pack of self-opening plastic bag pack of the invention.
Figure 21:
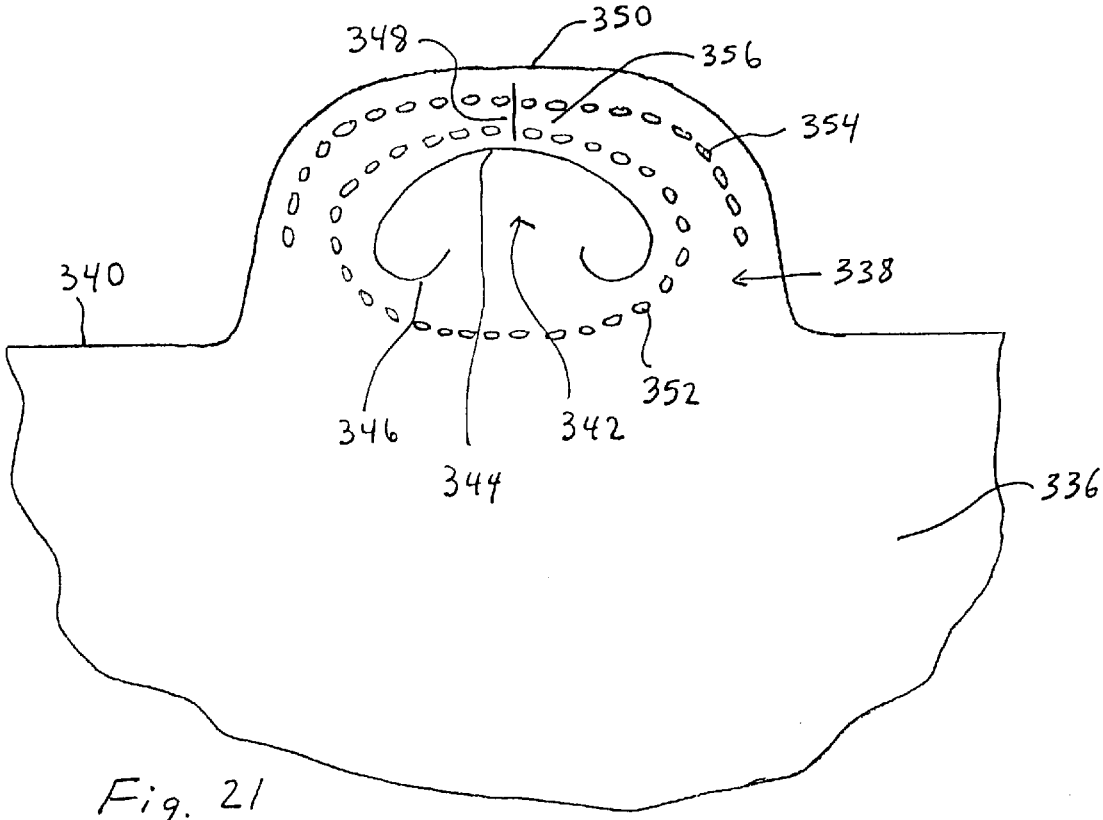
FIG. 21 is a detail of the center upper region of the bag pack of FIG. 20.

Turning to FIGS. 20 and 21, there is shown an eight embodiment of a self-opening plastic bag pack 308, comprising of a plurality of bags 310 stacked in registration and frangibly attached together. Each plastic bag 310 in pack of bags 308 has a lower bag portion 312 closed at a bottom edge 314 and has front and rear walls, 316 and 318, respectively. A pair of handles 320 extend upwardly and straddle mouth region 322 of bags 310 from side regions 324 of the bags 310. Bags 310 can be pleated along side regions 324. Handles 320 are sealed close along top edge 326. Pleating along side regions 324 provide for not only greater bag capacity, but also greater handle strength. Handle apertures 328 are formed in handles 320. Stacks of handles 320 in pack of bags 308 are maintained in stacked registration with temporary attachment means, such as cold pin bonding 330. For widening of handles 320 in regions of handle apertures 328, ear extensions 332 preferably can extend from inside edges 334 of handles 320. At an upper region 336 of bags 310 there are preferably extension portions 338 which extend above an upper edge 340 of bags 310 from front and rear walls 316 and 318 thereof. At least one bag pack suspension/handle aperture 342 is formed in upper region 336 of bag 310, and preferably at least partially and more preferably in extension portions 338. While suspension/handle aperture 342 can assume any number of shapes, a central curved center cut-line portion 344, with inwardly and upwardly curved end cut portions 346 provides a convenient hand-fitting shape, with the upwardly curved end portions 346 acting to protect bag integrity. A tear initiating slit 348 is formed in each extension portions 338, and preferably begins from a point near topmost edge 350 of extension portions 338 and extends downwardly toward, but not quite in contact with suspension/handle aperture 342. A pair of frangible bonding lines 352 and 354 are preferably formed through extension portions 338 in bag pack 310 adjacent suspension/handle aperture 342. Frangible bonding line 352 preferably can at least partially surround suspension/handle aperture 342 and frangible bonding line 354 can preferably be located adjacent a perimeter of extension portion 338.

The inventors have found that by incorporating a two spaced apart but generally close together frangible bonding lines 352-and 354 there is provided an extremely reliable self-opening feature. Placing frangible bonding lines 352 and 354 so that regions of lines 352 and 354 are generally parallel enhances reliability as well.

In use, a pack of bags 308 is hung on a hook of a bagging rack through suspension/handle aperture 342 (not shown.)

When a single bag 310 is pulled forward from a pack of bags 308 to remove it from bag pack 308, an upper region 356 of extension portion 338 of back wall 318 of front bag 310 and upper region 356 of extension portion 338 of front wall 318 of the following bag 310 tear through along slit 348, releasing extension portion 338. Due to the frangible bonding between the outsides of front and rear walls 316 and 318 of adjacent bags 310, the pulling force will automatically self-open the following bag 310. As with other embodiments of bags disclosed above, lines of compression frangible bonds 352 and 354 act to frangibly bond together the outside surfaces of front and rear walls 316 and 318, respectively, of adjacent bags 310. By pulling a frontmost bag open, the rear wall 318 of the front bag 310 (still frangible bonded to the front wall 316 of the following bag 310) will pull open the front wall 316 of following bag 310 in pack of bag 308. This opens and readies the. next bag 310 in pack 308 for immediate use.

Referring to FIGS. 22 and 23, there is shown a ninth embodiment of a pack 358 of self-opening plastic bags comprising a stack of individual bag 360 stacked in registration and frangibly attached together. Each plastic bag 360 in pack of bags 358 has a lower bag portion 362 closed at a bottom edge 364 and has front and rear walls, 366 and 368, respectively. In bags 360, a generally kidney-shaped aperture 370 is formed in an upper region 372 of bags 360. Aperture 370 is at least partially surrounded with areas of frangible bonding 374. Aperture 370 can be flapless, or more preferably can have a flap portion 376 positioned within aperture 370 and attached therein with webs 378 of uncut material, to thereby join flap portions 376 to upper portion of bag pack. Mounting apertures 380, adapted for receipt of a hook element of a bagging rack, are preferably formed within flap portion 376. Flaps 376 are permanently attached together in a book of flaps with hot pin welds 382.

Figure 24:
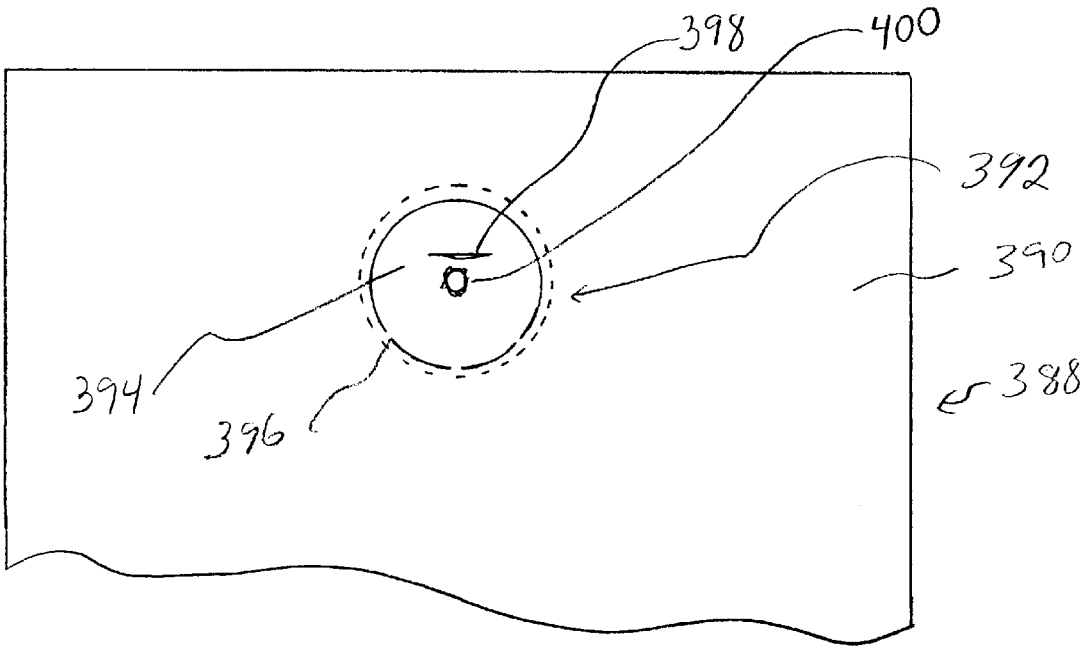
FIG. 24 a tenth embodiment of a pack of self-opening plastic bag pack of the invention.
Figure 25:
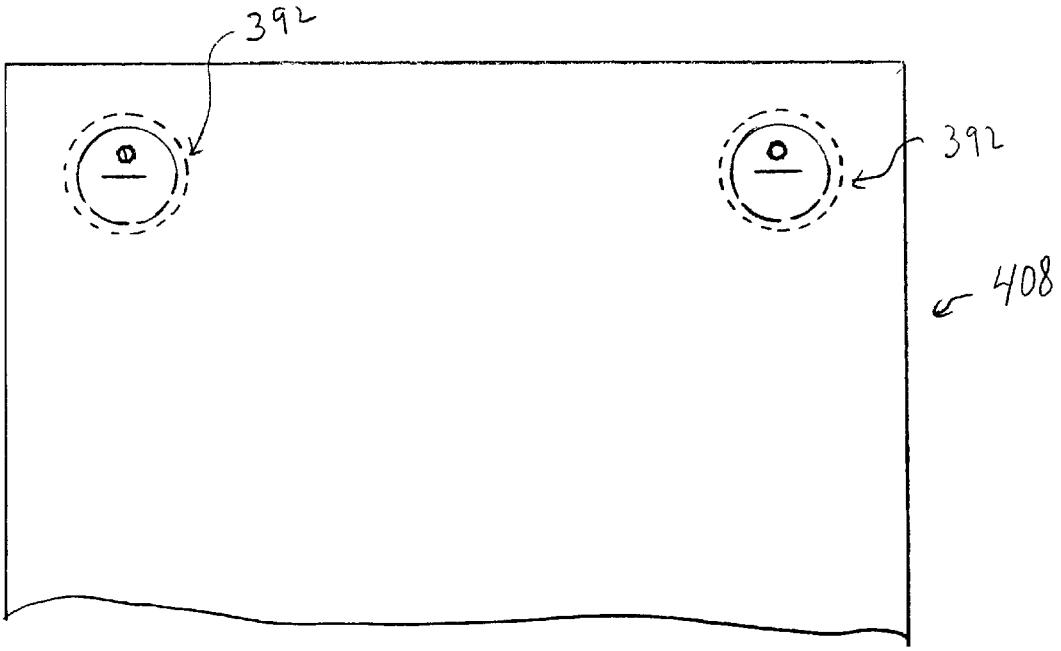
FIG. 25 an eleventh embodiment of a pack of self-opening plastic bag pack of the invention.

FIGS. 24 and 25 show the upper portions of two additional alternate bag pack designs. The embodiment of FIG. 24 shows bag pack 388, comprising bags 390 frangibly attached together. This bag pack embodiment is similar to that of FIG. 14, except bag pack has no extension portion. Aperture 392 preferably has a flap 394 attached with webs 396 to bag pack. An aperture 398 is formed in flap 394, and flaps 394 are heat welded together by heat weld 400. In the embodiment of the bag pack 408 of FIG. 25, a pair of these same style of apertures 392 are formed in the upper region of the bag pack 408.

Figure 26:
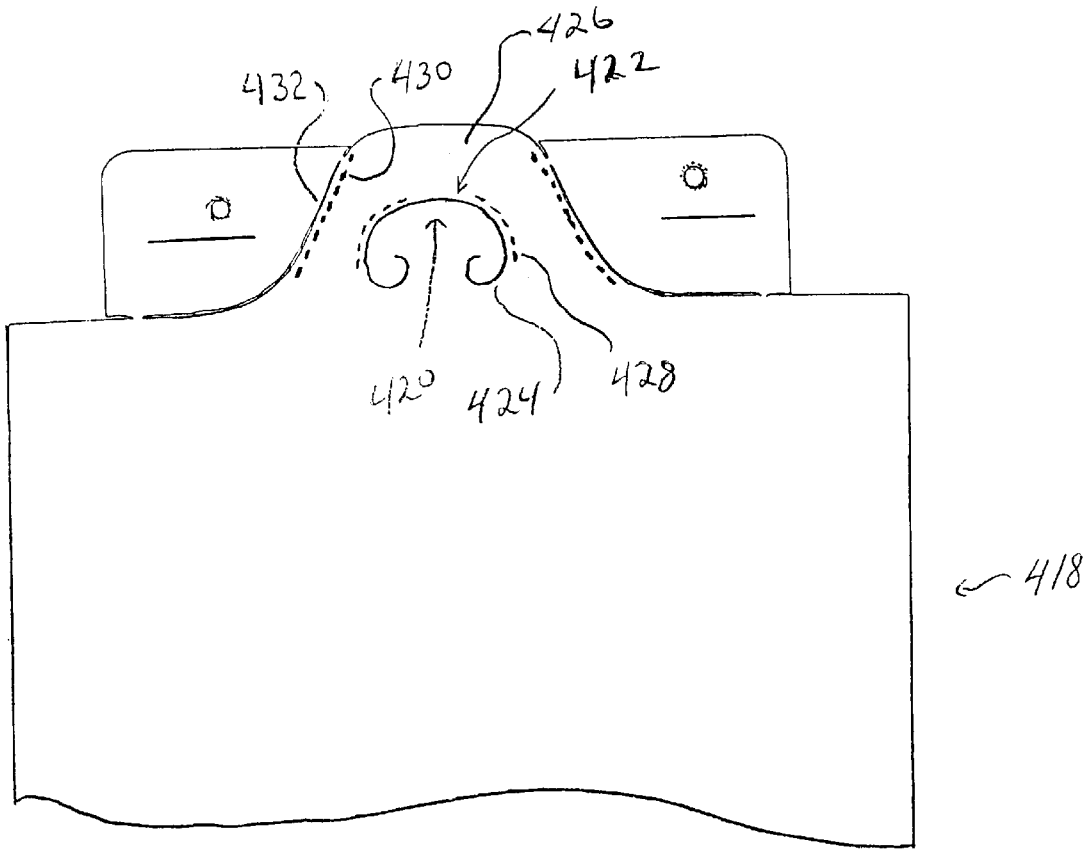
FIG. 26 an twelfth embodiment of a pack of self-opening plastic bag pack of the invention.

Turning to FIG. 26, there is shown another bag pack embodiment 418 of invention which is similar to the embodiment shown in FIG. 17, except that it has an aperture 420 defined by a cut line with an upwardly arching middle section 422 and inwardly curved end sections 424 formed in extension portion 426. Areas of frangible bonding 428 are preferably formed adjacent at least portions of aperture 420, and areas of frangible bonding 430 are also preferably formed adjacent to at least sections of a perimeter 432 of extension portion 426.

Figure 27:
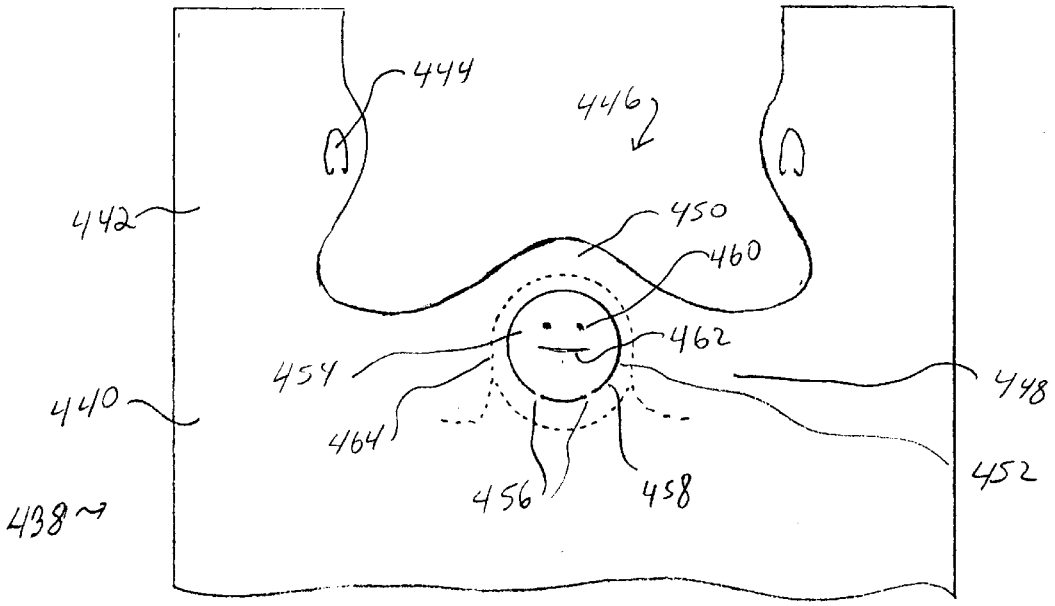
FIG. 27 a thirteenth embodiment of a pack of self-opening plastic bag pack of the invention.

Referring to FIG. 27 there is shown a view of a top portion of a thirteenth embodiment of a bag pack 438 of the invention comprises a plurality of frangibly bonded together individual bags 440. In this bag pack 438 handles 442, with handle apertures 444, straddle and extend upwardly from mouth area 446. At an upper region 448 of bags pack 438 there are preferably extension portions 450 which extend upwardly from front and rear walls of the bags 438. At least one bag pack suspension aperture 452 is formed in the upper region of bag 448 and/or partially or completely in extension portions 450. A relatively large detachable flap 454 can be formed within bag pack suspension aperture 452, and is preferably detachably attached therewithin with at least one uncut webs 456 to perimeter areas 458. Detachable flaps 454 are preferably affixed together as a "book" of flaps with a hot pin or a welded hole 460. A suspension aperture 462 is preferably formed though detachably flap 454, and can comprise a slit 462 (shown), hole, or another smaller flap (not shown.) Alternately, suspension aperture 462 can also incorporate welds (not shown.) Located around at least a portion of a periphery of aperture 452 are areas of frangible bonding 464.

Figure 28:
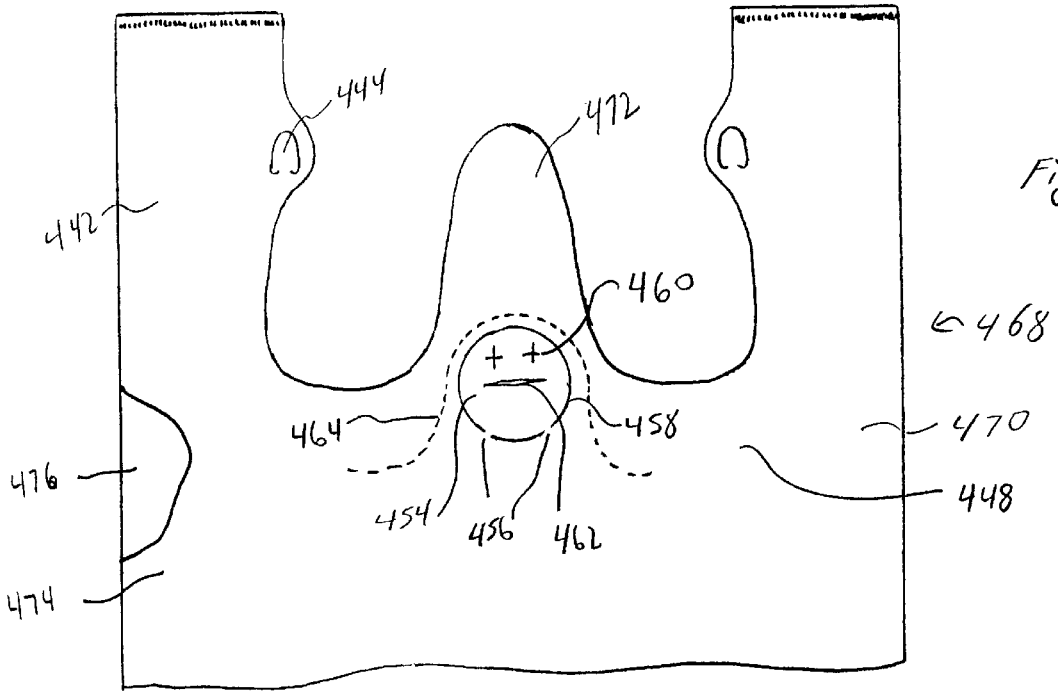
FIG. 28 a fourteenth embodiment of a pack of self-opening plastic bag pack of the invention.

Turning to FIG. 28 there is shown an upper portion of a fourteenth embodiment of a self-opening bag pack 468 comprising a plurality of frangibly bonded together individual bags 470. The bags in this bag pack are very similar to that of FIG. 27, and like reference numerals are used except that it comprises elongate extension straps 472 that extends upwardly in the mouth region 476 of bag pack 468 from the front and rear walls 474 and 476, respectively. Once the bag pack is removed from a bagging rack, the elongate extension straps 472 are available to be tied together, thus permitting the bag to be loaded with more merchandise without spilling than is typically the case.

A feature common to the self-opening bag embodiments of FIGS. 14–16, 22–25, 27, and 28 is that in all embodiments integral tabs are detachably retained in apertures contained in an upper region of the bags. In each case, when a single bag is removed from the pack of bags, the integral tabs are left affixed to the book of tabs on the bagging rack. The apertures thus formed in the removed bag will be completely surrounded by bag material in the upper portion of the bag, and the removed bag will remain strong.

Figure 29:
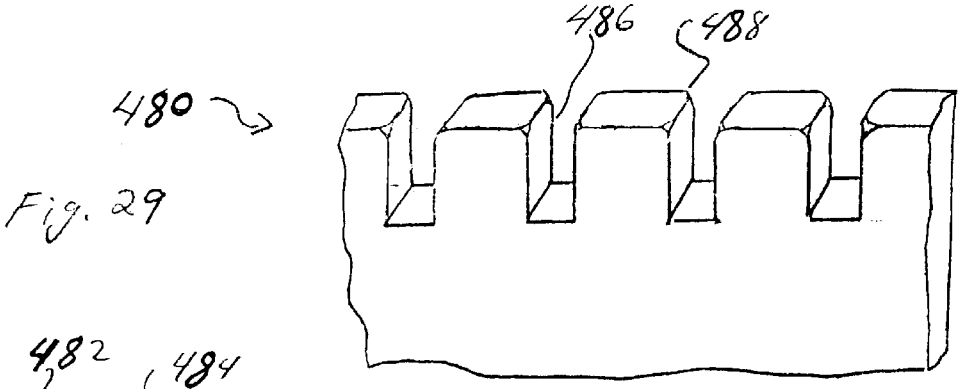
FIG. 29 is a top plan view showing the die used to form frangible compression bonds in the bag packs FIGS. 14–26.
Figure 30:
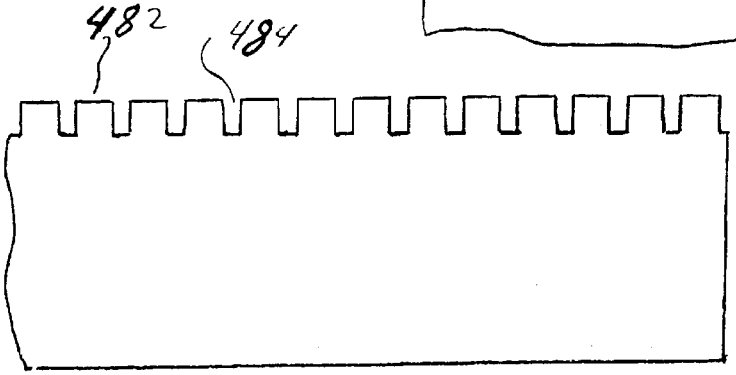
FIG. 30 is a top perspective detail view showing the compressing edge of the die of FIG. 27.

Referring now to FIGS. 29 and 30, there is shown view an embodiment of the frangible compression die 480 used in forming areas of frangible compression bonds in the bag designs of FIGS. 14–26. Die 480 can preferably comprise serrated teeth 482 with gaps 484 therebetween. Edges 486 and corners 488 of teeth 452 are free from sharp edges to prevent cutting of the plastic materials when die 480 is compressed onto a stack of bags being manufactured, with the teeth 482 forming the areas of frangible bonding. Other types of dies can also be utilized. However, the inventors have discovered that this type of die, which forms lines having alternating areas of frangible bonding and non-bonding provides excellent frangible bonding. The inventors have also had good results in utilizing pairs of these alternating lines of bonding and non-bonding in a variety of the self-opening bag designs disclosed herein above. Indeed, single and double lines of these alternating frangible bonds appear to function quite well in self-opening bag designs in general.

As previously reported in the inventors' pending application Ser. No. 08/866,815, the inventors have observed that the frangible bond strength formed, and thus the reliability of the self-opening feature of a bag pack, will not reach a maximum immediately following the manufacture of packs of self-opening bags, but will not increase to a full strength until after a few week's time. The inventors have found that the frangible bond strength can be maximized immediately to its full strength by treating the exterior surface of the plastic material of the continuous tube of plastic tube with static charging, to place a positive static charge on one exterior surface, e.g. the part which will be a front wall of the bag and a negative charge on the other exterior surface, e.g. on the part which will be a rear wall of the bags. As the pillowcases formed are placed in a stack, the opposite charges on opposing walls of adjacent bags cause static adhesion between opposite outer walls of the stacked bags. When the bag pack is cut and compress formed from statically charged material, the frangible bonding will achieve a maximum strength immediately. Static charging equipment such as offered by the Simco Company, Inc. of Hatfield, Pa., functions well. The spacing between the charging bars used to positively or negative charge the plastic material and the plastic sheet material, and the voltage delivered to the changing bars must be adjusted so that the static charge placed on the material will be present just on the outer surfaces of the plastic material, without penetrating too deeply into the plastic material, otherwise adjacent front and rear walls of bag material in each bag will be attracted together, and opening of each plastic bag will become difficult.

The inventors have also discovered that by applying a spot or spot charges of static charge (for example with one or more charging electrodes, such as having a single or multiple points) to one or more areas of an entire bag pack of stacked bags with higher intensity than was used with the static charging to the individual bags, even better self-opening results can be achieved (e.g. a bag pack treated with additional spot charges of static electricity will open even wider than non-static or single static treated bag packs. This extra charging can be applied anywhere on the bag pack, and functions particularly well in the mouth, handle, upper region, tab areas, and other portions of the bag. The precise voltage, electrode distance from bag pack can be adjusted to optimize opening. This single and double static charging is applicable to any self-opening bag pack design.

In a further development, the inventors have discovered a new way to utilize static neutralization to improve self-opening of any style of bag pack. In the past, it has been know that static electricity on the surfaces of materials, including thin film plastic, can cause a whole host of problems, including machinery jams, attraction of dust and dirt, and damage to sensitive electronic equipment. In the field of manufacturing plastic film and plastic bags, excess static charge on inside surfaces of the plastic material (typically opposite and attracting charges on opposed walls) causes the walls to stick together, making their separation somewhat difficult. In an attempt to counteract this recognized problem, equipment vendors, such as the Simco Company, Inc. offer static neutralizers. In the field of plastic bag manufacturing, these static neutralizers are presently used as follows. A roll of plastic bag film is first manufactured and is rolled onto a spool in a flattened tube condition. If the bag from which the roll of material is to be pleated, either before or after the roll is placed on a pleating machine, and with the roll of material in a lay flat condition with the opposed walls of plastic material in contact with each other, the flattened plastic bag material is passed by a static neutralizer bar. Utilizing this procedure, the inventors have found that the static neutralization does not function effectively because invariably some opposite static charges form on the insides of opposite walls of plastic material, thereby tending to draw opposite walls into close contact with each other and defeating the purpose of static neutralization. The inventors have discovered that if the bag tube material is treated for static neutralization, for example by being passed by a static neutralization bar when the opposing walls of the bag tube material are separated, (e.g. by being inflated with air or otherwise), then the air within the bag tube will be treated to be relatively free from static charge. When the thus treated bag tube material is flattened, the inside walls of bag pack material will carry less or practically no static charges, and therefore will tend not to attract each other. Used alone, or in conjunction with single or double static charging, and with corona treatment and compression bonding, and improved self-opening feature results.

The drawings and the foregoing description are not intended to represent the only form of the invention in regard to the details of this construction and manner of operation. In fact, it-will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following the claims which follow.

What is claimed is:

1. A pack of self-opening plastic bags for use with a bagging rack having suspension arms, comprising:

a bag pack having plurality of bags stacked in alignment, each of said bags having front and rear walls with outer surfaces, a pair of upwardly extending handles, each handle having an aperture formed therethrough, said opposed walls being closed at a bottom edge and at least partially openable at a top to define a mouth region between the pair of handles, extension portions extending upwardly from front and rear walls, a suspension aperture formed in an upper region of the bags and at least partially in the extension portions, and a tear initialing slit formed in the extension portions adjacent the suspension aperture, wherein the outer surface of the front wall is treated with one of a positive and negative static charge, and the outer surface of the rear wall is treated with the other of a positive and negative static charge, wherein the bags have additional areas of applied static charging, and wherein the outer surfaces of the front and rear walls of the plurality of bags of ache pack of bags are held tog ether by areas of frangible bonding comprising two elongate lines of frangible pressure bonding portions of the elongate lines being adjacent to each other, which elongate lines frangibly bond together outer surfaces of front and rear walls of adjacent bags to provide for self-opening of a following bag as a topmost bag is removed from the bag pack.

2. A pack of self-opening plastic bags for use with a bagging rack, comprising:

a bag pack having a plurality of bags stacked in alignment, each of the bags having front and rear walls with outer surfaces, the opposed walls being closed at a bottom edge and at least partially openable at a top to define a mouth region, at least one extension portion extending upwardly from the front and rear walls, an aperture formed in an upper region of the bags, the outer surfaces of the front and rear walls of the plurality of bags of the pack of bags being held together by areas of frangible pressure bonding comprising an elongate line comprising a large number of closely spaced together frangible areas which frangibly bonds together outer surfaces of front and rear walls of adjacent bags to provide for self-opening of a following bag as a topmost bag is removed from the bag pack, wherein the outer surface of the front wall is treated with one of a positive and negative static charge, and the outer surface of the rear wall is treated with the other of a positive and negative static charge, and wherein the bags have additional areas of applied static charging.

* * * * *